US009259624B2

(12) United States Patent
Frank et al.

(10) Patent No.: US 9,259,624 B2
(45) Date of Patent: Feb. 16, 2016

(54) GAME BALL WITH GRIP ZONES

(71) Applicant: PSI 91, Inc., Springfield, MA (US)

(72) Inventors: John P. Frank, Vernon, CT (US); Daniel P. Touhey, Florence, MA (US); Louis Swiszcz, Chicopee, MA (US)

( * ) Notice: Subject to any disclaimer, the term of this patent is extended or adjusted under 35 U.S.C. 154(b) by 0 days.

(21) Appl. No.: 14/445,142

(22) Filed: Jul. 29, 2014

(65) Prior Publication Data

US 2015/0031482 A1 Jan. 29, 2015

Related U.S. Application Data

(60) Provisional application No. 61/859,558, filed on Jul. 29, 2013.

(51) Int. Cl.

| | |
|---|---|
| ***A63B 43/00*** | (2006.01) |
| *A63B 37/12* | (2006.01) |
| *A63B 41/08* | (2006.01) |

(52) U.S. Cl.

CPC ..... *A63B 43/002* (2013.01); *A63B 37/12* (2013.01); *A63B 41/085* (2013.01); *A63B 2243/0066* (2013.01)

(58) Field of Classification Search

CPC .. A63B 43/02; A63B 41/08; A63B 2243/007; A63B 2243/0066; A63B 41/085; A63B 37/12

See application file for complete search history.

(56) References Cited

U.S. PATENT DOCUMENTS

| | | | | | |
|---|---|---|---|---|---|
| 1,559,117 | A | * | 10/1925 | Maynard | 473/596 |
| 1,931,429 | A | * | 10/1933 | Buckner et al. | 473/596 |
| 2,194,674 | A | * | 3/1940 | Riddell | 473/597 |
| 2,270,553 | A | * | 1/1942 | Potito | 473/596 |
| 5,195,745 | A | * | 3/1993 | Rudell et al. | 473/573 |
| 5,480,144 | A | * | 1/1996 | Downing | 473/599 |
| 5,570,882 | A | * | 11/1996 | Horkan | 473/438 |
| 6,722,889 | B1 | * | 4/2004 | Page et al. | 434/251 |
| 6,761,654 | B2 | * | 7/2004 | Murphy et al. | 473/596 |
| D505,462 | S | * | 5/2005 | Horkan et al. | D21/712 |
| D505,463 | S | * | 5/2005 | Horkan et al. | D21/712 |
| 2006/0046879 | A1 | * | 3/2006 | Kelly et al. | 473/603 |
| 2012/0142464 | A1 | * | 6/2012 | Smith et al. | 473/597 |
| 2013/0324333 | A1 | * | 12/2013 | McNamee | 473/599 |
| 2015/0031481 | A1 | * | 1/2015 | Frank et al. | 473/596 |
| 2015/0045160 | A1 | * | 2/2015 | Lo | 473/604 |

* cited by examiner

*Primary Examiner* — Steven Wong

(74) *Attorney, Agent, or Firm* — Richard M. Klein; Fay Sharpe LLP

(57) ABSTRACT

The present disclosure relates to a game ball having one or more grip zones that have greater frictional interaction compared to the outer surface of the game ball. The grip zones are made by stitching of a coated thread upon at least one cover panel to create the grip zone. The grip zone formed from the coated thread enhances the handling characteristics and playability of the resulting game ball.

11 Claims, 20 Drawing Sheets

GAME BALL WITH GRIP ZONES

CROSS-REFERENCE TO RELATED APPLICATIONS

This application claims priority to U.S. Provisional Patent Application Ser. No. 61/859,558, filed on Jul. 29, 2013. The entirety of that application is hereby fully incorporated by reference in its entirety.

BACKGROUND

The present disclosure relates generally to inflatable game balls having one or more grip zones that improve the handling characteristics of the ball. Methods of making such grip zone (s) using a soft, compressible, elastic thread stitched into the outer cover panel(s) of the ball are also disclosed. The stitches and/or resulting grip zone may have an enhanced coefficient of friction (or frictional coefficient) over other components of the ball, and the resulting grip zone provides better grip, handling, and playability characteristics. These methods are particularly useful for enhancing the grippability of the covers of certain inflated game balls or sportsballs, such as those used for throwing, kicking, and catching in the games of rugby, American football, or Canadian football.

In this regard, a football or rugby ball has a generally prolate spheroid shape (i.e. egg-shaped) with lacing on top of the ball. The specific size, shape, and construction of the ball differ depending upon league rules and regulations. Such balls are designed to meet certain specifications. For example, the National Collegiate Athletic Association (NCAA) requires that all footballs used for gameplay are marked with two 1-inch white stripes covering one-half the circumference (i.e. the top panels) of the ball. These stripes are located about 3 inches from the end of the ball. Some rugby balls do not have lacing or stripes.

When used in play, a football and/or rugby ball is contacted by players in a variety of different ways and using a variety of techniques. For example, a football player can carry, hold, throw, and/or catch the game ball frequently during the course of a game.

The feel or touch of the game ball can affect the tempo and result of the game. For example, if the surface of a game ball is too smooth, it may be very difficult for a receiver to catch a football or for a running back to maintain the ball in his hands while running. Similarly, if the game ball has a surface that is too slick, the quarterback may have difficulty throwing the football with the desired degree of precision, or a kicker may have difficulty kicking the ball accurately. This is especially true during play in inclement weather conditions.

It would be desirable to provide game balls that have enhanced grip characteristics, as well as alternative methods for making such game balls.

BRIEF SUMMARY

The present disclosure relates to a game ball, such as a football, with one or more grip zones. The grip zones are formed by using a soft, compressible, elastic thread to form stitches that together create the grip zone. The thread, stitches, and/or resulting grip zone have a greater static coefficient of friction than the cover layer of the game ball, and thus has improved grip or texture. The thread is preferably raised above the outer surface of the cover layer. The stitching provides an improved gripping surface for the user/player. The stitching also facilitates the player's abilities in certain situations, e.g. to spin or spiral the ball when thrown, which generally causes the ball to travel straighter and farther.

Disclosed in various embodiments herein is a game ball, comprising: an inflatable bladder; and a cover layer surrounding the bladder, the cover layer being formed from a plurality of cover panels. At least one of the cover panels includes at least one grip zone formed from stitches created by a thread interwoven into the cover panel, the grip zone having a static coefficient of friction greater than a static coefficient of friction of an outer surface of the cover panel, when measured according to ASTM D1894 using the pebbled side of a Pattern 62 glass as the test surface.

The at least one grip zone may have an annular shape or a trapezoidal shape.

The at least one grip zone may include a first grip zone and a second grip zone, the first grip zone and the second grip zone both being located on the same longitudinal side of the at least one cover panel, and the first grip zone and the second grip zone forming a first set of grip zones.

Sometimes, the game ball further comprises a second set of grip zones on an opposite longitudinal side of the cover panel. In particular embodiments, the first grip zone has an annular shape, and the second grip zone has a different annular shape. In other embodiments, the first grip zone has a trapezoidal shape, and the second grip zone has a different trapezoidal shape.

In other embodiments, the at least one cover panel includes a first stripe member attached to the outer surface on a first longitudinal side of the cover panel, the first stripe member having a first stripe edge adjacent the outer surface and a second stripe edge adjacent the outer surface.

Sometimes, the at least one grip zone includes a first grip zone and a second grip zone, the first grip zone being located on the outer surface next to the first stripe edge, and the second grip zone being located on the outer surface next to the second stripe edge.

In other embodiments, the at least one grip zone is located upon the first stripe member between the first stripe edge and the second stripe edge.

In yet different embodiments, the game ball has a lacing that defines a first plane and a second plane which are orthogonal to a longitudinal axis of the game ball, and the at least one grip zone parallels the lacing and is located between the first plane and the second plane.

In particular embodiments, the at least one grip zone includes a first grip zone having an ogive shape and located at a first longitudinal end of the at least one cover panel. The at least one grip zone can further include a second grip zone having an ogive shape and located at a second longitudinal end of the at least one cover panel.

In embodiments, the game ball further comprises a lacing. Depending on the desired configuration, the at least cover panel having the at least one grip zone is a top panel that contacts the lacing, or alternatively, the at least cover panel having the at least one grip zone is a bottom panel that does not contact the lacing.

Also disclosed in various embodiments herein is a game ball, comprising: an inflatable bladder; a cover layer surrounding the bladder, the cover layer being formed from a plurality of cover panels; and a lacing. The plurality of cover panels includes at least one top panel that contacts the lacing and includes at least one bottom panel that does not contact the lacing; and the cover layer includes at least one grip zone formed from stitches created by a thread interwoven into the cover layer, the grip zone having a static coefficient of friction greater than a static coefficient of friction of the cover layer, when measured according to ASTM D1894 using the pebbled side of a Pattern 62 glass as the test surface.

In specific embodiments, the at least one grip zone includes a first grip zone, a second grip zone, a third grip zone, and a fourth grip zone on the cover layer. The first grip zone and the third grip zone are of identical shape; and the second grip zone and the fourth grip zone are of identical shape to each other but a different shape from the first grip zone and the third grip zone.

In more specific embodiments, the first grip zone is located on a first longitudinal side of the at least one top panel proximate a center of the top panel, the second grip zone is located on the first longitudinal side of the at least one top panel distal the center of the top panel, the third grip zone is located on a second longitudinal side of the at least one top panel proximate the center of the top panel, and the fourth grip zone is located on the second longitudinal side of the at least one top panel distal the center of the top panel.

Sometimes, the at least one top panel includes a first stripe member attached to the outer surface on a first longitudinal side of the top panel and a second stripe member attached to the outer surface on a second longitudinal side of the top panel, each stripe member having an interior stripe edge proximate the lacing and an exterior stripe edge distal to the lacing. In some embodiments including stripe members, the first grip zone is next to the interior stripe edge of the first stripe member, the second grip zone is next to the exterior stripe edge of the first stripe member, the third grip zone is next to the interior stripe edge of the second stripe member, and the fourth grip zone is next to the exterior stripe edge of the second stripe member.

Sometimes, the at least one top panel has a horizontal edge which contacts the at least one bottom panel and a vertical edge which contacts the lacing; and the first grip zone is located upon the first stripe member proximate to the vertical edge, the second grip zone is located upon the first stripe member proximal to the horizontal edge, the third grip zone is located upon the second stripe member proximal to the vertical edge, and the fourth grip zone is located upon the second stripe member proximal to the horizontal edge.

In different embodiments, the at least one bottom panel has a horizontal edge which contacts the at least one top panel and a vertical edge which contacts another bottom panel; and the first grip zone is located on a first longitudinal side of the at least one bottom panel proximate a center of the at least one bottom panel, the second grip zone is located on the first longitudinal side of the at least one bottom panel distal the center of the at least one bottom panel, the third grip zone is located on a second longitudinal side of the at least one bottom panel proximate the center of the at least one bottom panel, and the fourth grip zone is located on the second longitudinal side of the at least one bottom panel distal the center of the at least one bottom panel. In these variations, the first grip zone, the second grip zone, the third grip zone, and the fourth grip zone can be proximate the horizontal edge. Alternatively, the first grip zone, the second grip zone, the third grip zone, and the fourth grip zone can be distal to the horizontal edge.

In particular embodiments of the game ball, the at least one grip zone includes a first grip zone and a second grip zone, wherein the first grip zone and the second grip zone are of identical shape; the at least one top panel includes a first stripe member attached to the outer surface on a first longitudinal side of the top panel and a second stripe member attached to the outer surface on a second longitudinal side of the top panel; and the first grip zone is located on the at least one bottom panel in parallel with the first stripe member and the second grip zone is located on the at least one bottom panel in parallel with the second stripe member.

In other embodiments, the lacing defines a first plane and a second plane which are orthogonal to a longitudinal axis of the game ball; the at least one grip zone includes a first grip zone and a second grip zone, the first grip zone and the second grip zone being of identical shape; the first grip zone parallels the lacing and is located between the first plane and the second plane on one side of the lacing; and the second grip zone parallels the lacing and is located between the first plane and the second plane on the other side of the lacing.

In other embodiments, the at least one grip zone includes at least eight grip zones, with at least four grip zones being located on the at least one top panel and at least four grip zones being located on the at least one bottom panel.

In specific embodiments, every cover panel in the plurality of cover panels has a grip zone of ogive shape located at a first longitudinal end of the game ball.

Also disclosed in various embodiments herein is a game ball, comprising: an inflatable bladder; a cover layer surrounding the bladder, the cover layer being formed from a plurality of cover panels; a lacing; and a stitching proximate the lacing, wherein the stitching is formed from a thread interwoven into the cover layer and has a static coefficient of friction greater than a static coefficient of friction of an outer surface of the cover layer.

The stitching can have a pattern selected from the group consisting of zigzag, straight, zipper, loop, arch, and combinations thereof.

The game ball may further comprise a patch between the bladder and the cover layer and located under the lacing, the stitching being located on a perimeter of the patch.

These and other non-limiting characteristics are more particularly described below.

DESCRIPTION OF THE DRAWINGS

The following is a brief description of the drawings, which are presented for the purpose of illustrating the exemplary embodiments disclosed herein and not for the purpose of limiting the same.

DETAILED DESCRIPTION

Figure 1:
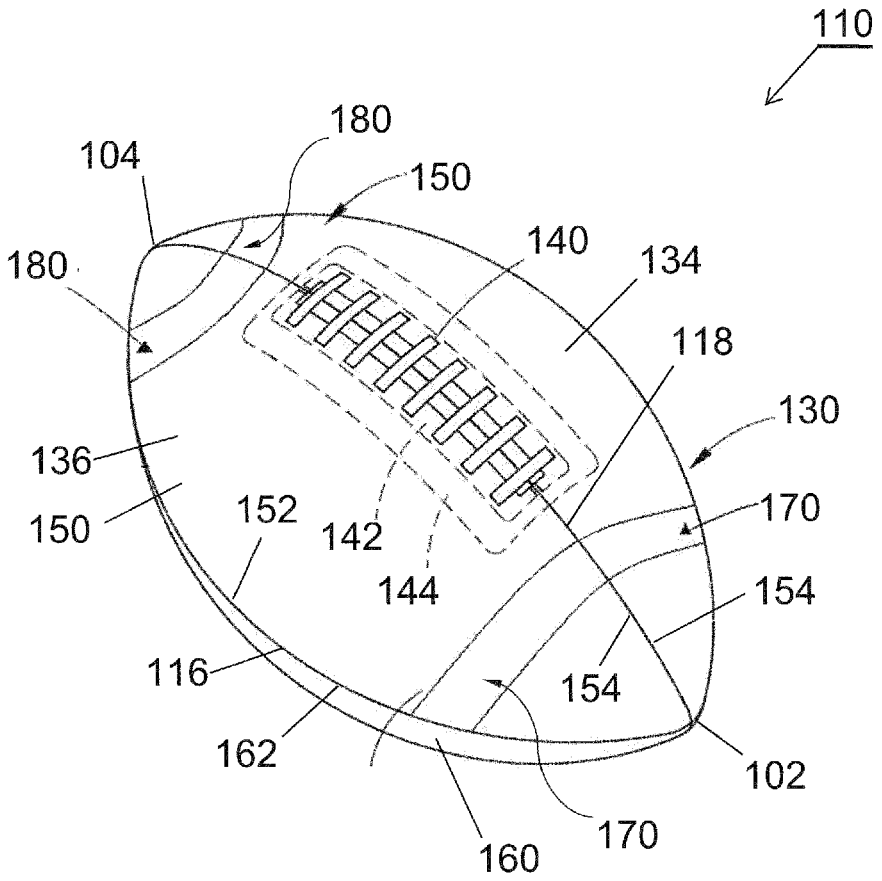
FIG. 1 is an exterior view of an American football with which the threading/stitching of the present disclosure having an enhanced coefficient of friction can be used.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The singular forms "a," "an," and "the" include plural referents unless the context clearly dictates otherwise.

As used in the specification and in the claims, the term "comprising" may include the embodiments "consisting of" and "consisting essentially of."

Some of the terms used herein are relative terms. For example, the terms "interior", "exterior", "inner", and "outer" are relative to a center. These terms should not be construed as requiring a particular orientation.

The term "mirror image" is used to refer to the three-dimensional shape of an object as reflected in a plane mirror. This term is used in shorthand, and should not be construed as requiring absolute conformance in every detail.

The term "parallel" should be construed in its lay term as two edges or faces generally continuously having the same distance between them, and should not be strictly construed in mathematical terms as requiring that the two edges or faces cannot intersect when extended for an infinite distance.

The present disclosure relates to game balls having one or more grip zones that are made from a thread, and to methods of making such game balls. The grip zones are located on the cover panel(s) of the game ball, are made from raised stitches of a soft, compressible, elastic thread, and have a greater static coefficient of friction than the outer surface of the game ball (i.e. the outer surface of the cover panels). This enhances the handling and playability of the game ball.

A "stripe" as described herein is a line applied to the game ball to increase visibility or represent league affiliation. For example, white stripes on American footballs are required for NCAA® collegiate football competition, but are not found on footballs used at the professional level National Football League ("NFL"). The term "stripe" or "stripes" is used here to refer to the roughly 1-inch-thick lines that are added to the outer/exterior surface of a cover panel of an American football and located about 3 to 3.25 inches from the end of the cover panel.

Figure 2:
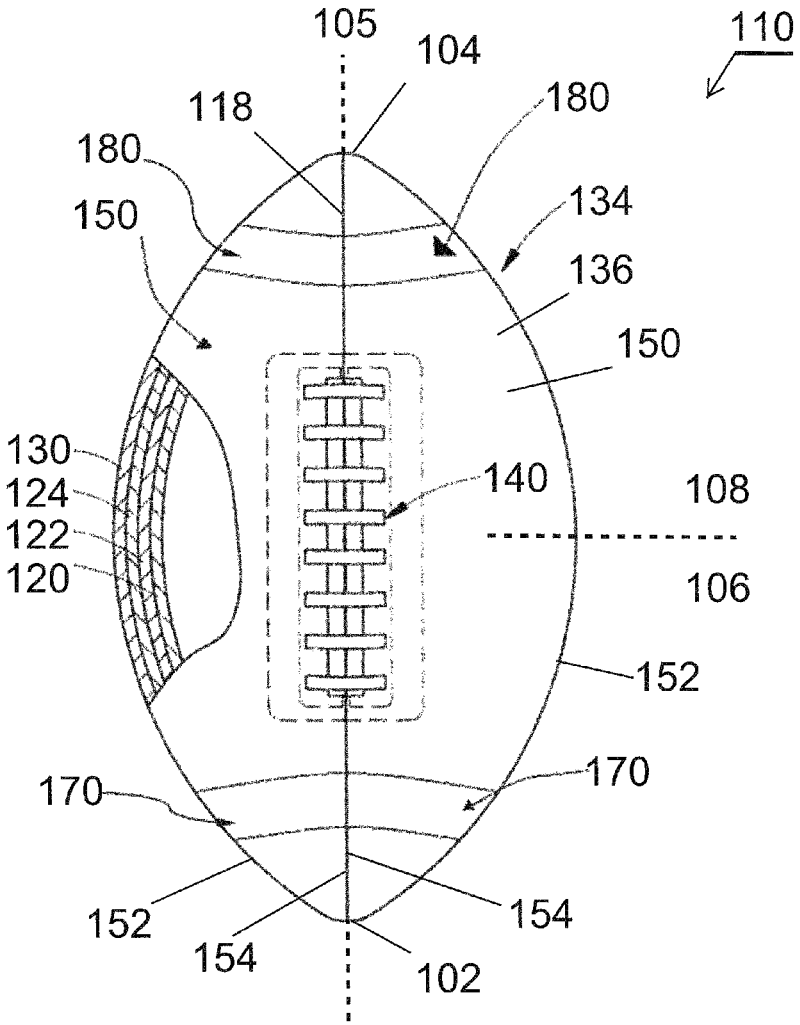
FIG. 2 is a top view and a partial cross-sectional view of the football of FIG. 1.
Figure 3:
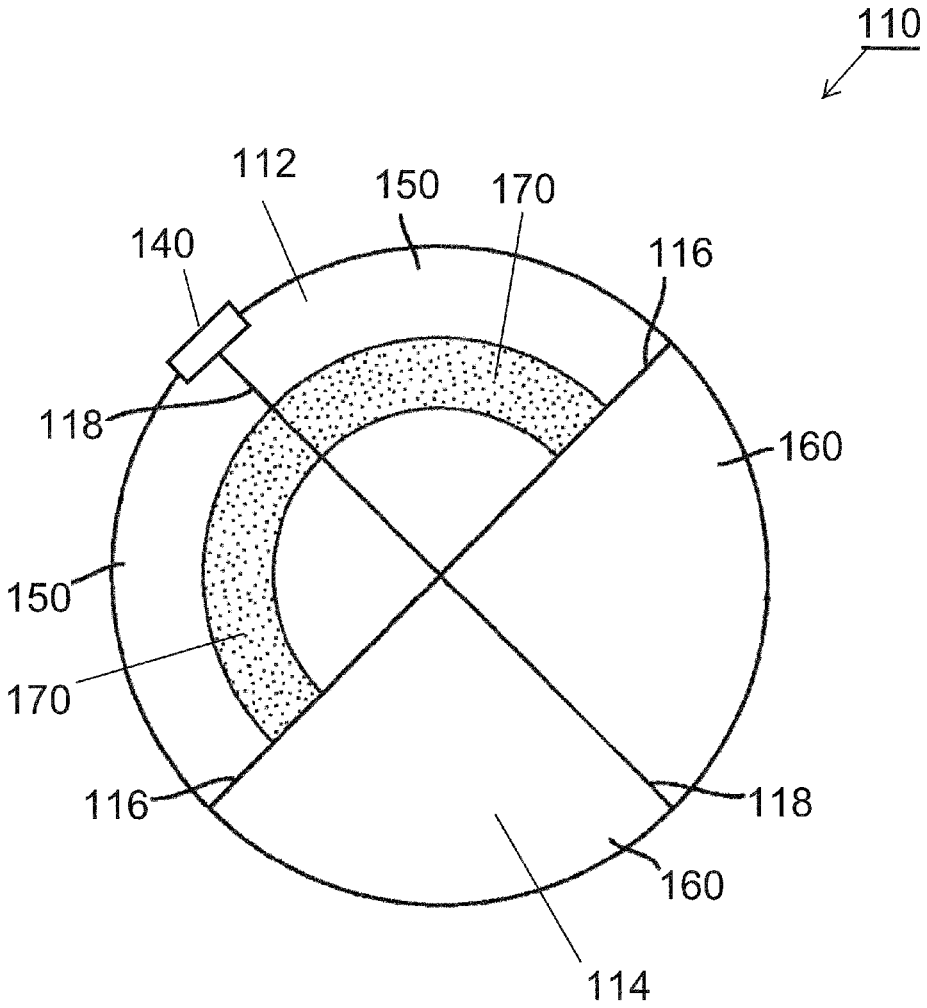
FIG. 3 is an end view of the football of FIG. 1.
Figure 4:
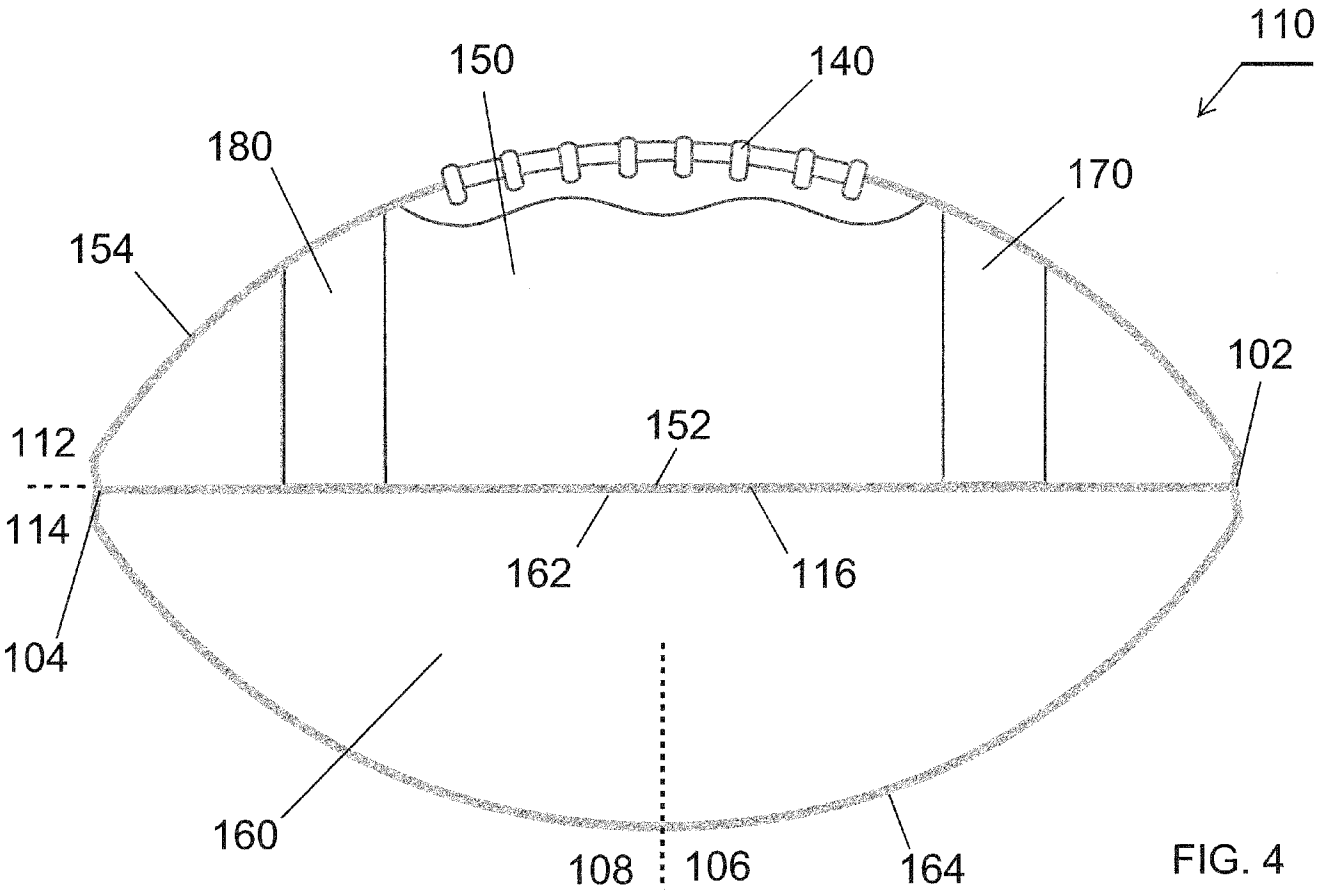
FIG. 4 is a side view of the football of FIG. 1.

FIGS. 1-4 are various views of a conventional American football, and provides reference points for the discussion of the grip zones that will follow afterwards. FIG. 1 is an exterior view of the football 110. FIG. 2 is a cross-sectional view of the same football 110. FIG. 3 is an end view of the same football 110. FIG. 4 is a side view of the same football 110.

Referring to these three figures together, a cover layer 130 makes up the outer/exterior surface of the football. Inside the football (i.e. under the cover layer) is a bladder 120. Surrounding the bladder 120 is a cloth liner 122, then a foam liner 124, then the cover layer 130. The cloth liner, foam liner, and cover layer are generally made in multiple pieces that are combined to make a panel 134; four panels 134 are used to form the cover layer 130 that covers the football 110. The outer surface 136 of the cover panels makes up the outer surface of the football. The four panels are joined together by stitching on three seams and by a combination of stitching and lacing at the fourth seam. The lacing area includes the lacing 140, optionally a patch material 142 stitched to the underside of the panels 134 through which lacing 140 penetrates, and optionally a tongue 144 located between the bladder 120 and the lacing 140 which has penetrated the patch material 142. Stitching may be present on the cover panels proximate the lacing, for example to hold the patch material and/or common in place relative to the cover panel. It is noted that rugby balls may not have lacing at all.

Of the four panels in this embodiment, two are considered to be top panels 150, and two are considered to be bottom panels 160. A top panel 150 contacts the lacing 140, wherein a bottom panel does not contact the lacing. This is best seen in FIG. 3. Each top panel 150 has a horizontal edge 152 which contacts a bottom panel, and a vertical edge 154 which contacts the lacing 140. Each bottom panel 160 has a horizontal edge 162 which contacts a top panel (best seen in FIG. 4). Each bottom panel here also has a vertical edge 164 which contacts another bottom panel. However, it is contemplated that in embodiments having different numbers of panels (e.g. three or five panels), it is possible that a bottom panel will be flanked on both sides by only top panels or only bottom panels. The game ball has two horizontal seams 116 and two vertical seams 118. Each horizontal seam 116 is formed where the horizontal edges of two cover panels meet, and each vertical seam 118 is formed where the vertical edges of two cover panels meet (best seen in FIG. 3). It should be noted that the lacing 140 is located along one of the vertical seams. The top half 112 of the game ball contains the lacing 140 at the center, while the bottom half 114 of the game ball does not contain the lacing. Here, a plane passing through the two horizontal seams 116 will divide the ball into the top half 112 and the bottom half 114.

A longitudinal axis 105 extends through the two longitudinal ends 102, 104 of the game ball. The game ball can also be bisected into two longitudinal sides 106, 108 which are generally mirror images of each other (with the exception of graphics, logos, etc.), shown in FIG. 2 on either side of a dotted line.

Each top panel has two stripe members 170, 180 on the outer surface. The stripe members are located on opposite longitudinal sides of the top panel 150.

Figure 5:
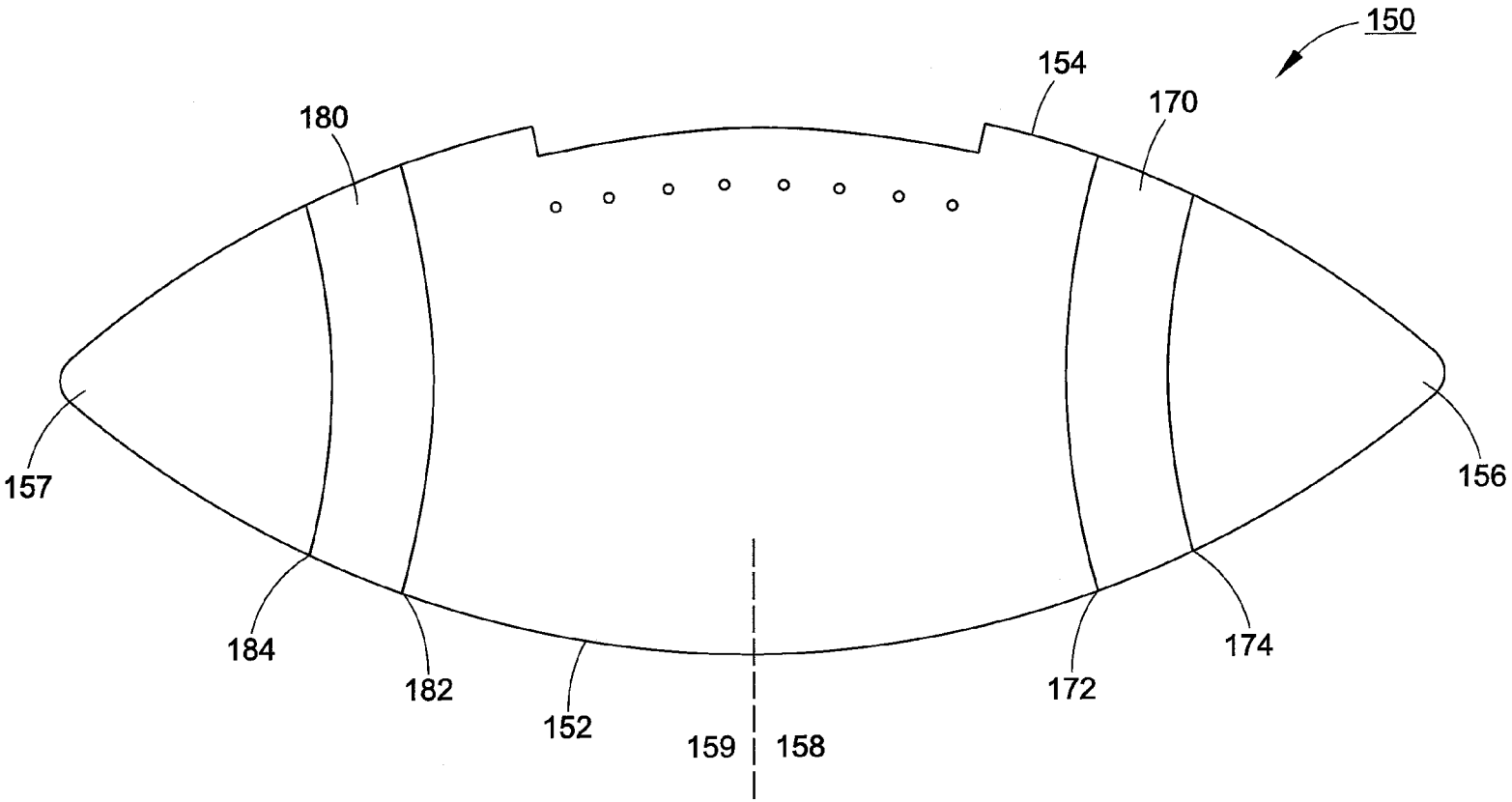
FIG. 5 is a two-dimensional top view of a top cover panel prior to being combined with other cover panels to form a three-dimensional game ball.

FIG. 5 is a top view of a top cover panel 150 in its two-dimensional flattened form prior to being sewn together to form a three-dimensional game ball. This top panel has a horizontal edge 152 and a vertical edge 154, both of which have an arcuate shape. The first longitudinal end 156 and the second longitudinal end 157 of the cover panel have an ogive shape. The term "ogive" refers to the intersection formed by two curves that have the same radius of curvature, and could alternatively be thought of as a "bullet" shape. The vertical edge here has a slight cutout and holes for the lacing.

A first stripe member 170 is present on the first longitudinal side 158 of the cover panel, and a second stripe number 180 is present on the second longitudinal side 159 (longitudinal sides on either side of a dotted line). As seen in this two-dimensional view, each stripe member has an annular shape. The term "annular" refers to a four-sided shape wherein two opposite sides are formed by parallel arcs of concentric circles of different diameters. Each stripe member has a first or interior stripe edge 172, 182 and a second or exterior stripe edge 174, 184.

The present disclosure relates to game balls having one or more grip zones that are made from a thread, to cover panels for a game ball that have one or more grip zones made from a thread, and to methods of making such game balls. The thread is used to form stitches that make up the grip zone. The resulting grip zone has a greater static coefficient of friction than the outer surface of the game ball (i.e. the outer surface of the cover panel), which makes it easier for users to catch, hold, or grip the ball. Generally speaking, the grip zones can be placed in any number and any location on the game ball that is helpful for enhancing the grip of the ball. The game ball generally includes a plurality of cover panels that includes at least one top panel and at least one bottom panel, as discussed further herein.

Figure 6:
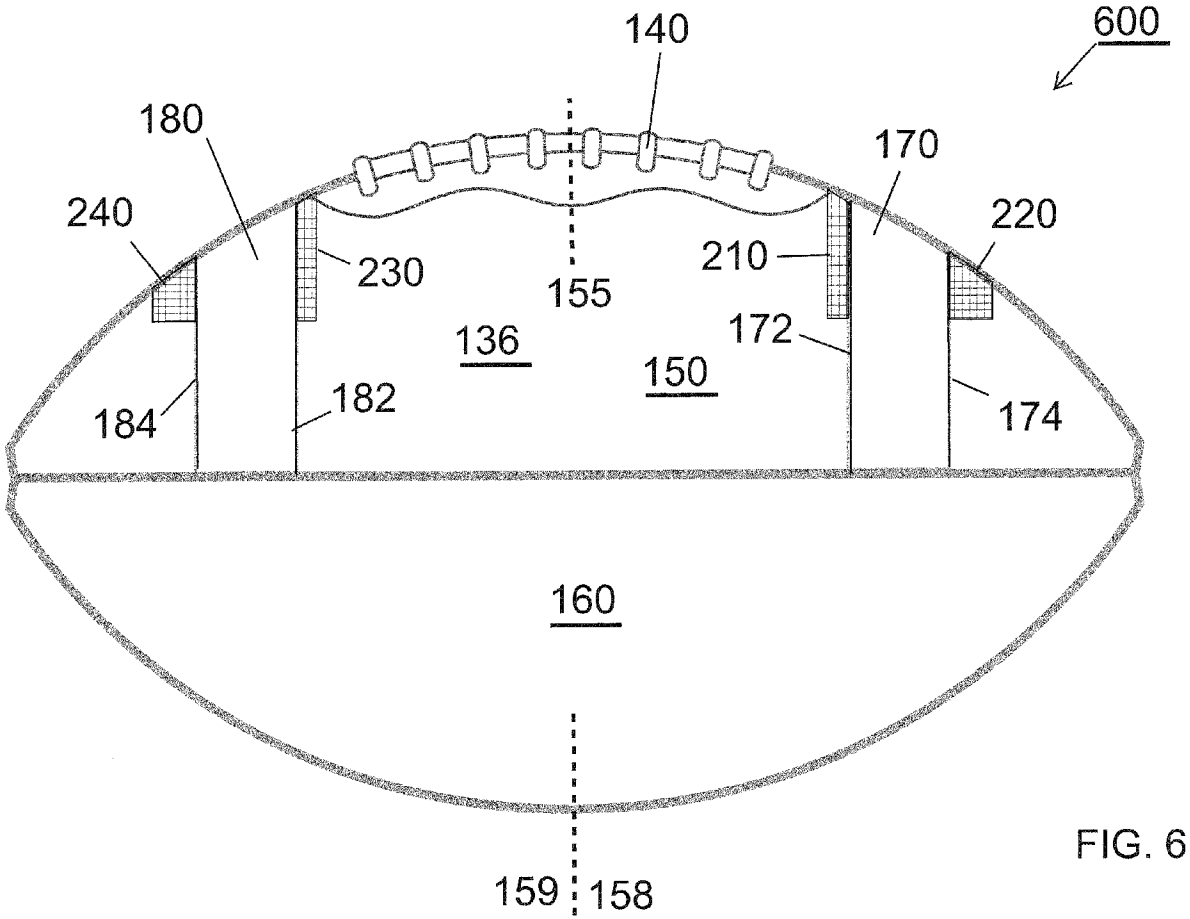
FIG. 6 is a side view of a first exemplary embodiment of a football with grip zones.
Figure 7:
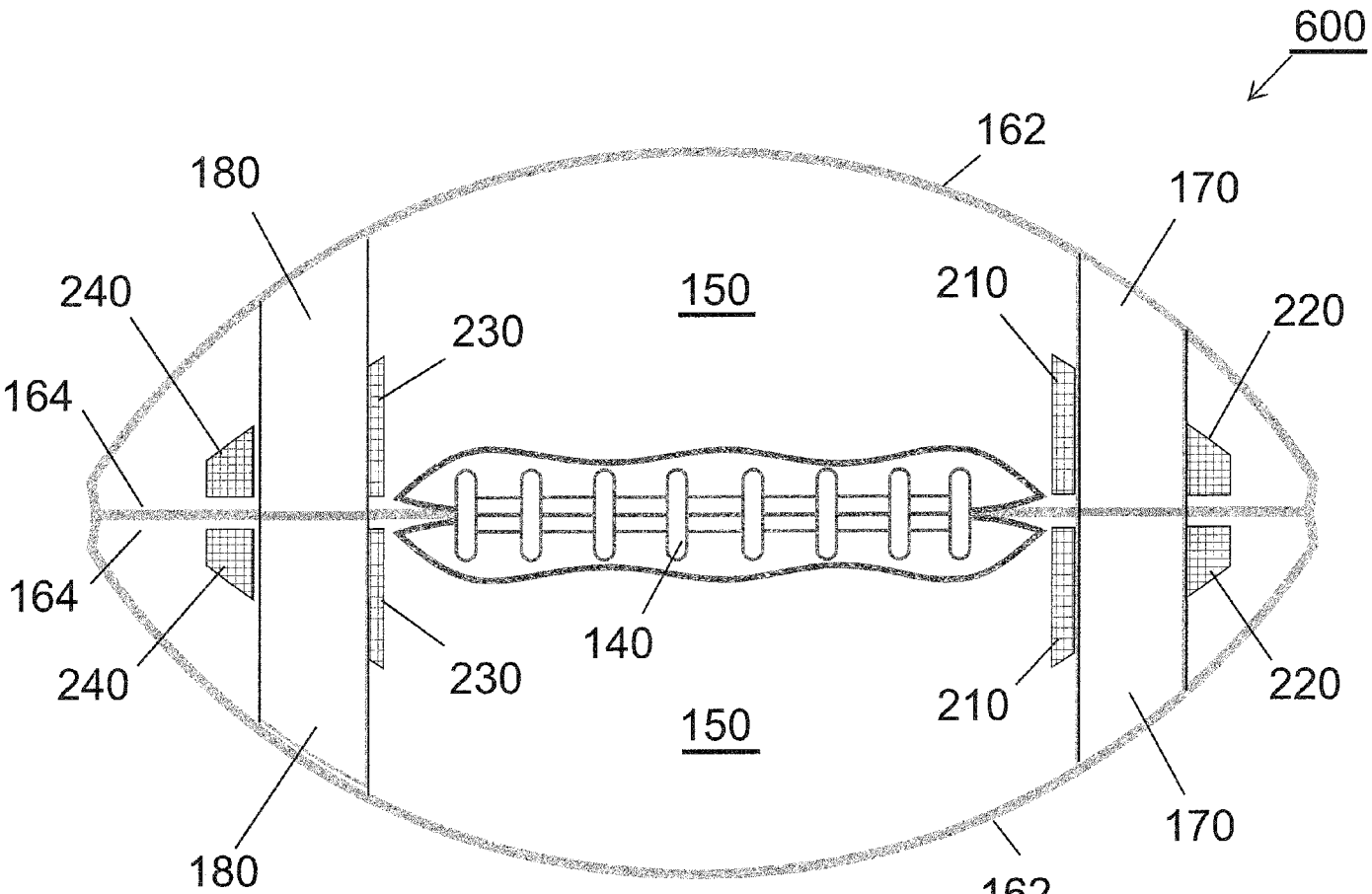
FIG. 7 is a top view of the first exemplary embodiment of FIG. 6.

FIG. 6 is a side view of one exemplary embodiment of a game ball 600 of the present disclosure having grip zones. FIG. 7 is a top view of the same game ball.

A top cover panel 150 and a bottom cover panel 160 are visible in FIG. 6, the top panel being distinguishable by the presence of two stripe members 170, 180 and the lacing 140. As previously noted, the game ball of the present disclosure has at least one grip zone (i.e. one or more grip zones). In this embodiment, a first grip zone 210, a second grip zone 220, a third group zone 230, and a fourth group zone 240 are present on the top panel 150.

The first grip zone 210 and the second grip zone 220 are both located on the same longitudinal side 158 of the cover panel. The third grip zone 230 and the fourth grip zone 240 are both located on the same longitudinal side 159 of the cover panel, opposite the first and second grip zones. The first grip zone 210 and the second grip zone 220 may be considered to form a first set of grip zones, and the third and fourth grip zones 230, 240 may be considered a second set of grip zones on the opposite longitudinal side of the cover panel. As seen here, the first grip zone and the second grip zone have different shapes. The first grip zone and the third grip zone have the same/identical shape as each other (suitably reversed), and the second grip zone and the fourth grip zone have the same/identical shape as each other (suitably reversed).

In embodiments, each grip zone can have a trapezoidal shape, such as an annular shape. The term "trapezoidal" refers to a polygon having four sides, with at least two opposite sides being parallel to each other. An annular shape is a subset of trapezoidal shapes.

The first grip zone 210 and the third grip zone 230 may be described as being proximate the center 155 (indicated by dotted line) of the top panel 150, while the second grip zone 220 and the fourth grip zone 240 may be described as being distal to the center 155 of the top panel.

A first stripe member 170 is attached to the outer surface 136 of the top cover panel 150 on the first longitudinal side 158. A second stripe member 180 is attached to the outer surface of the top cover panel on the second longitudinal side 159. Each stripe member has a first or interior stripe edge 172, 182, and a second or exterior stripe edge 174, 184. Put another way, the interior stripe edge 172, 174 is proximate the lacing 140 and the exterior stripe edge 174, 184 is distal to the lacing.

In FIG. 6, the first grip zone 210 is located on the outer surface next to the interior stripe edge 172 of the first stripe member, and the second grip zone 220 is located on the outer surface next to the exterior stripe edge 174. Similarly, the third grip zone 230 is located on the outer surface next to the interior stripe edge 182 of the second stripe member, and the fourth grip zone 240 is located on the outer surface next to the exterior stripe edge 184.

FIG. 7 shows two top panels 150, each with a first stripe member 170, a second stripe member 180, a first grip zone 210, a second grip zone 220, a third grip zone 230, a fourth grip zone 240, and a single lacing 140 contacting both top panels. In addition, the horizontal edge 162 and the vertical edge 164 of each panel are indicated.

Figure 8:
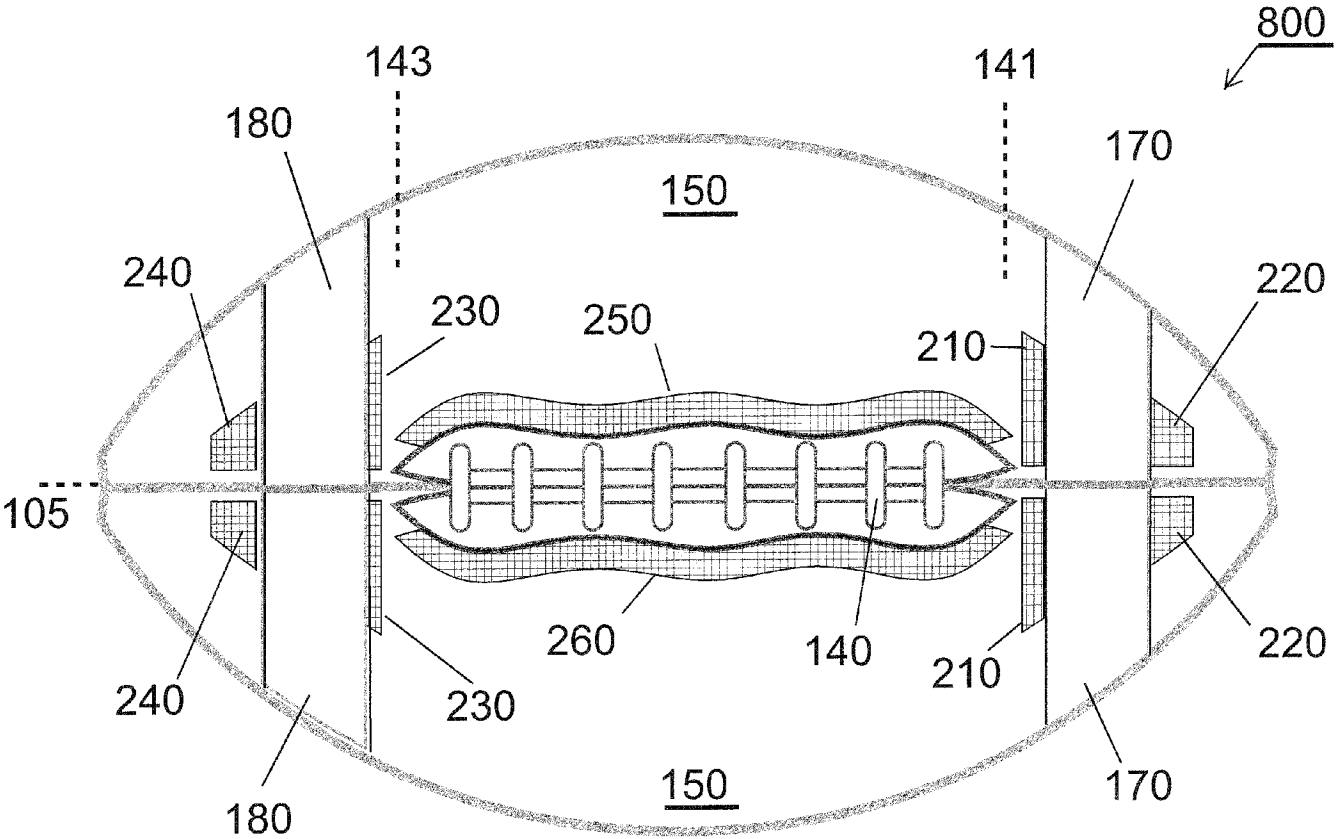
FIG. 8 is a top view of a second exemplary embodiment of a football with grip zones. Here, two additional grip zones parallel the lacing.

FIG. 8 is a top view of a second exemplary embodiment 800 of the present disclosure. This embodiment is similar to that seen in FIG. 7. The two top panels 150 each have a first stripe member 170, a second stripe member 180, a first grip zone 210, a second grip zone 220, a third grip zone 230, and a fourth grip zone 240, and a single lacing 140 contacts both top panels.

In addition, FIG. 8 contains two additional grip zones 250, 260. The ends of the lacing define a first plane 141 and a second plane 143 (indicated by dotted lines), both of which are orthogonal to the longitudinal axis 105 of the game ball. Each of the additional grip zones 250, 260 parallels the lacing 140 and is located between the first plane and the second plane.

Figure 9:
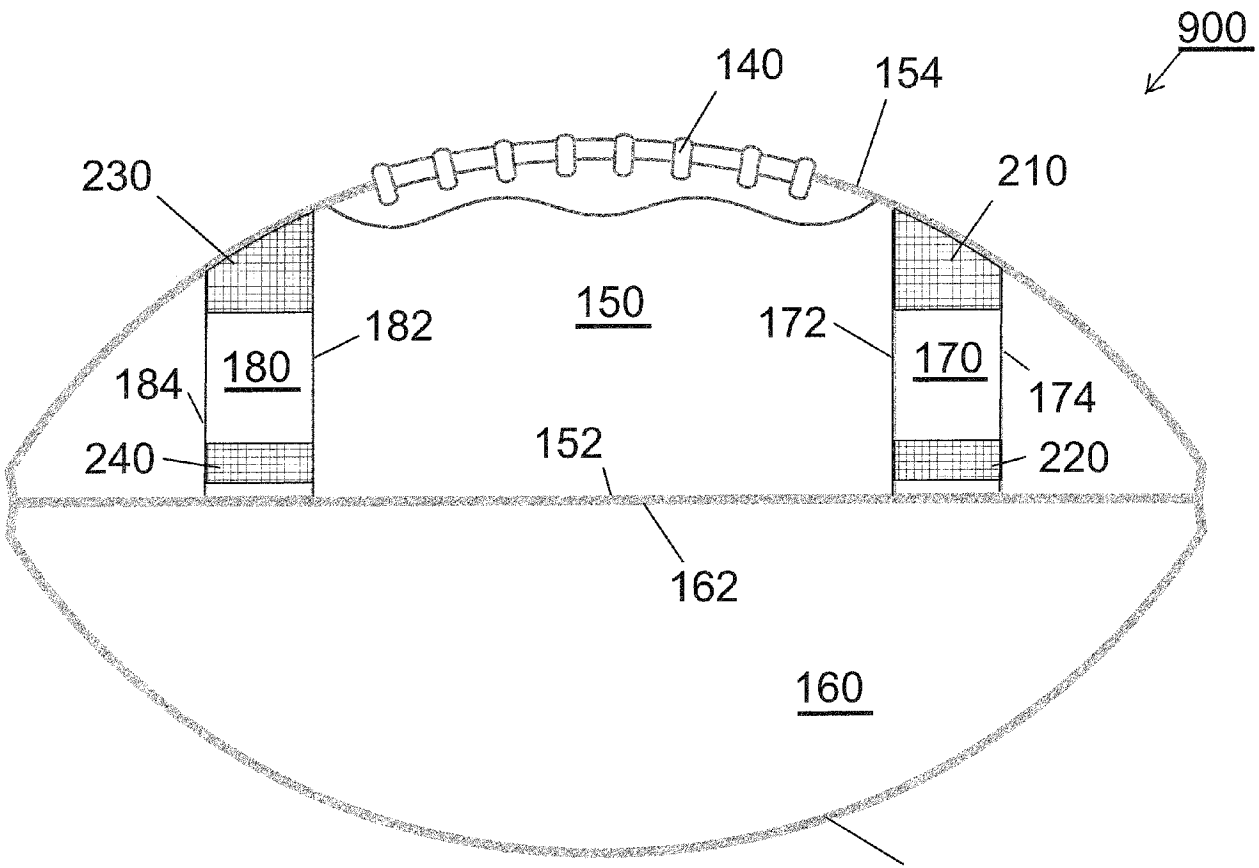
FIG. 9 is a side view of a third exemplary embodiment of a football with grip zones. Here, the grip zones are present on the stripe members on the top panels.

FIG. 9 is a side view of a third exemplary embodiment 900 of the present disclosure. Here, the top panel 150 includes a first stripe member 170, a second stripe member 180, a first grip zone 210, a second grip zone 220, a third grip zone 230, and a fourth grip zone 240. Each stripe member has a first or interior stripe edge 172, 182, and a second or exterior stripe edge 174, 184. The bottom panel 160 does not have any stripe numbers or any grip zones. The horizontal edge 152, 162 and the vertical edge 162, 164 of each panel are also indicated. The vertical edge of the top panel 150 contacts the lacing 140.

Here, each grip zone is located upon a stripe member 170, 180, i.e. between the first stripe edge 172, 182 and the second stripe edge 174, 184. As illustrated here, the first grip zone 210 and the third grip zone 230 have the same shape and are located proximal to the vertical edge 154 of the top panel 150, but are located upon different stripe members. Similarly, the second grip zone 220 and the fourth grip zone 240 have the same shape and are located proximal to the horizontal edge 152 of the top panel (i.e. distal to the vertical edge), but are located upon different stripe members. The first grip zone 210 and the second grip zone 220 have different shapes.

Figure 10:
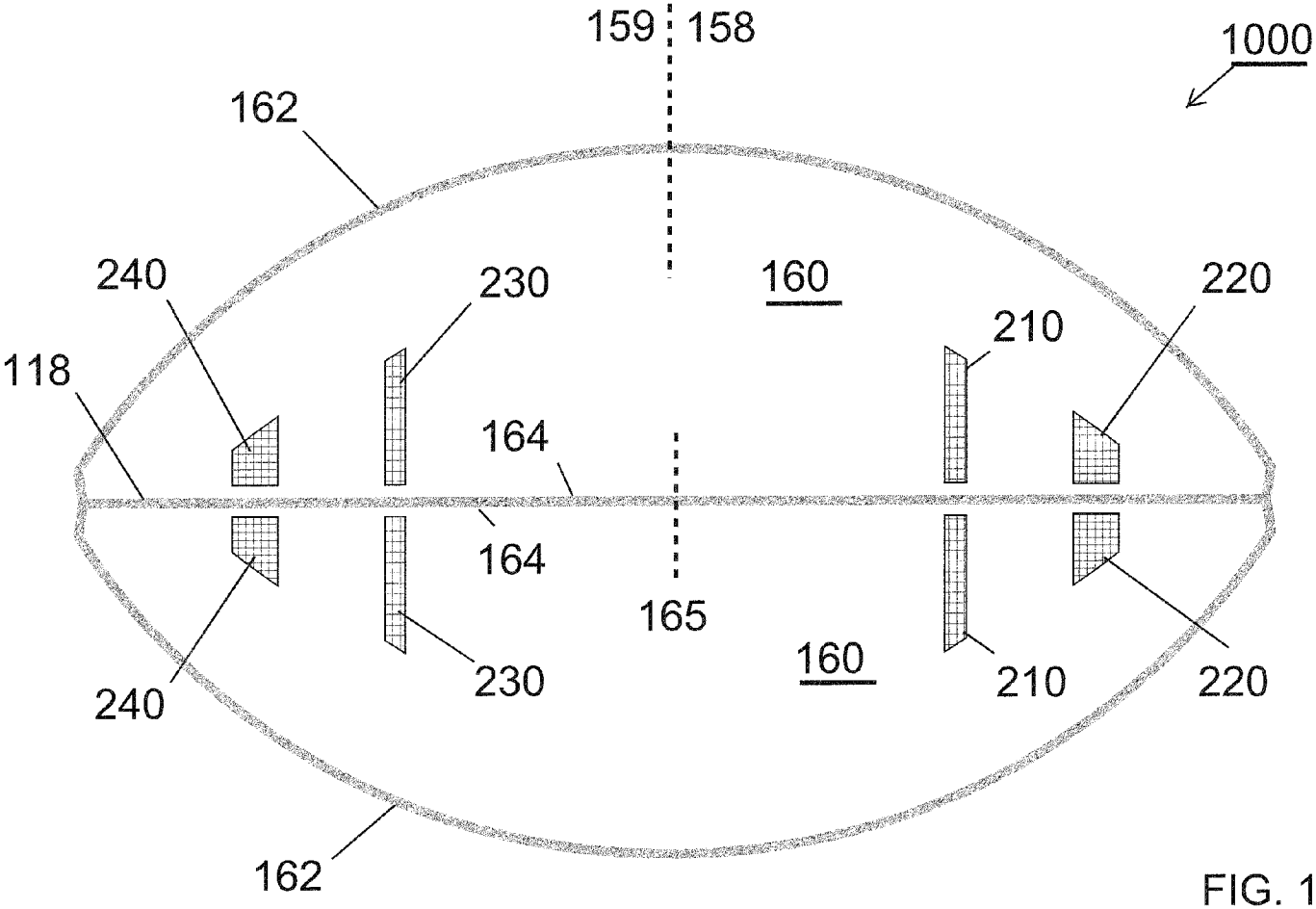
FIG. 10 is a bottom view showing a fourth exemplary embodiment of a football with grip zones. Here, the grip zones are present on the bottom panels.

FIG. 10 is a bottom view of a fourth exemplary embodiment 1000 of the game ball of the present disclosure. Here, two bottom panels 160 are shown. Each bottom panel has a first grip zone 210, a second grip zone 220, a third grip zone 230, and a fourth grip zone 240. In addition, the horizontal edge 162 and the vertical edge 164 of each panel and a vertical seam 118 of the game ball are indicated.

The first grip zone 210 and the third grip zone 230 may be described as being proximate the center 165 (indicated by short dotted line) of the bottom panel 160, while the second grip zone 220 and the fourth grip zone 240 may be described as being distal to the center 165 of the bottom panel. The first grip zone 210 and the second grip zone 220 are both located on the same longitudinal side 158 (indicated by long dotted line) of the panel. The third grip zone 230 and the fourth grip zone 240 are both located on the same longitudinal side 159 of the panel, opposite the first and second grip zones. Here, the four grip zones are distal to the horizontal edge 162 of the bottom panel, or put another way are proximate the vertical edge 164. However, in some embodiments (not shown here), the four grip zones are proximate the horizontal edge of the bottom panel. The grip zones on the bottom panel can be placed in different locations, for example to accommodate different user hand lengths.

Figure 11:
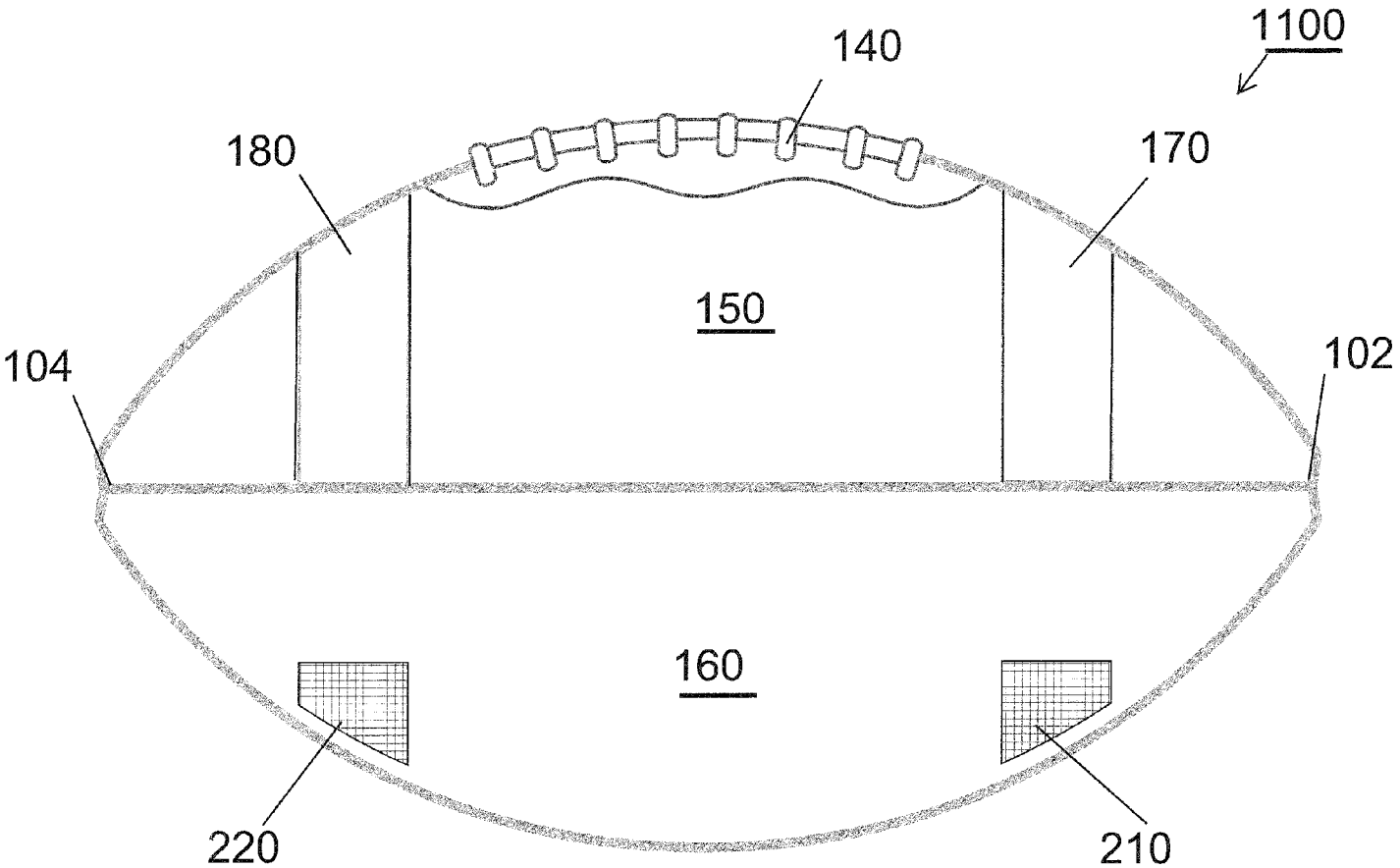
FIG. 11 is a side view showing a fifth exemplary embodiment of a football with grip zones. Here, the grip zones are also present on the bottom panels.

FIG. 11 is a side view of a fifth exemplary embodiment 1100 of the game ball of the present disclosure. Here, two stripe members 170, 180 are shown on the top panel 150 for reference purposes. The bottom panel 160 has a first grip zone 210 and a second grip zone 220. The first grip zone 210 is located in parallel with the first stripe member 170, and the second grip zone 220 is located in parallel with the second stripe member 180. Put another way, the grip zones are located about 3 to 3.25 inches from the longitudinal ends 102, 104 of the game ball/bottom panel.

Figure 12:
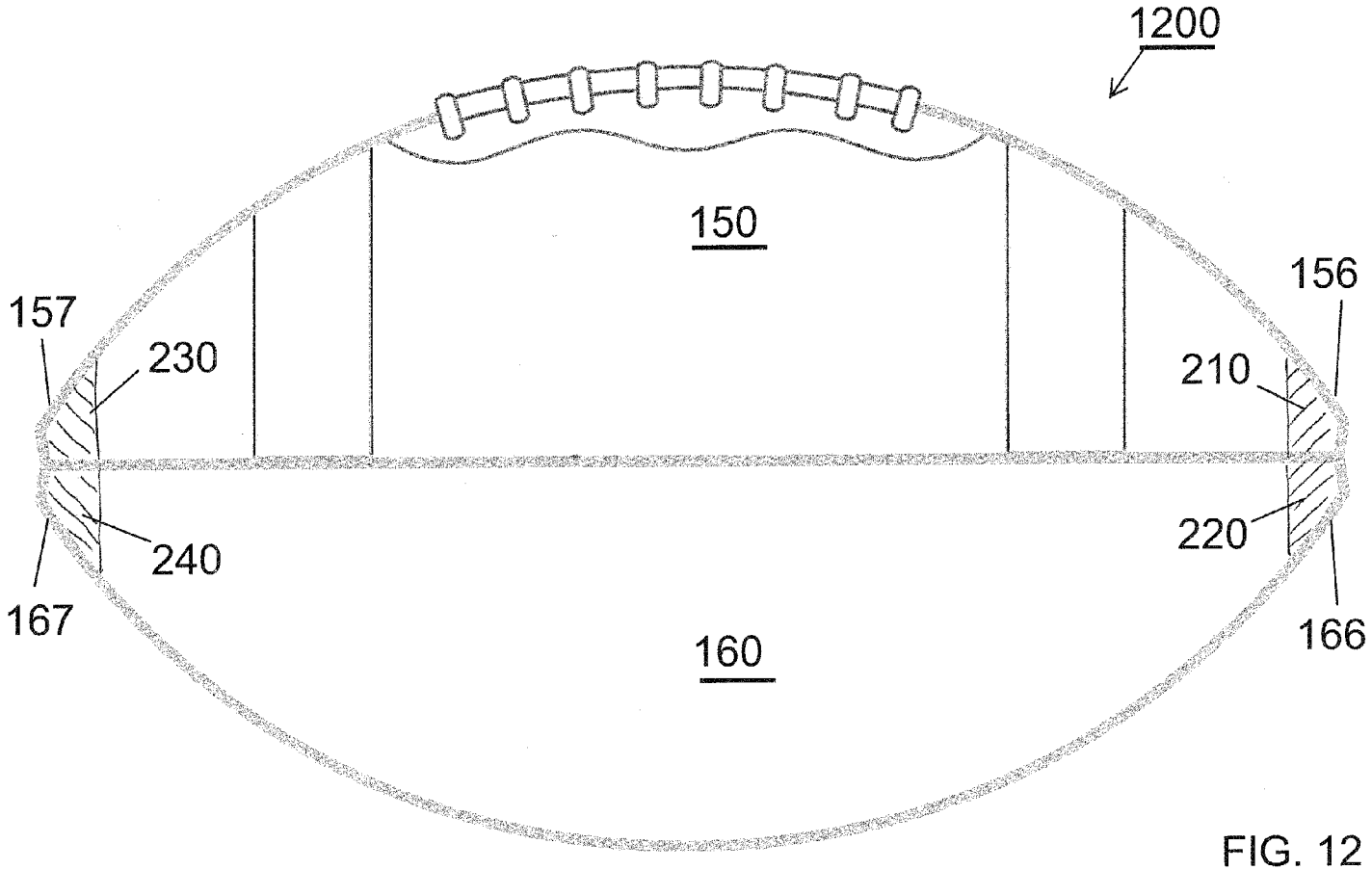
FIG. 12 is a side view showing a sixth exemplary embodiment of a football with grip zones. Here, the grip zones are present at the longitudinal ends of the football.

FIG. 12 is a side view of a sixth exemplary embodiment 1200 of the game ball of the present disclosure. Here, the top panel 150 and the bottom panel 160 each have an ogive grip zone 210, 220, 230, 240 located at their first longitudinal end 156, 166 and their second longitudinal end 157, 167. These grip zones may be useful for enhancing the grip of the placekick holder, for example during a field goal or a point-after-touchdown.

Figure 13:
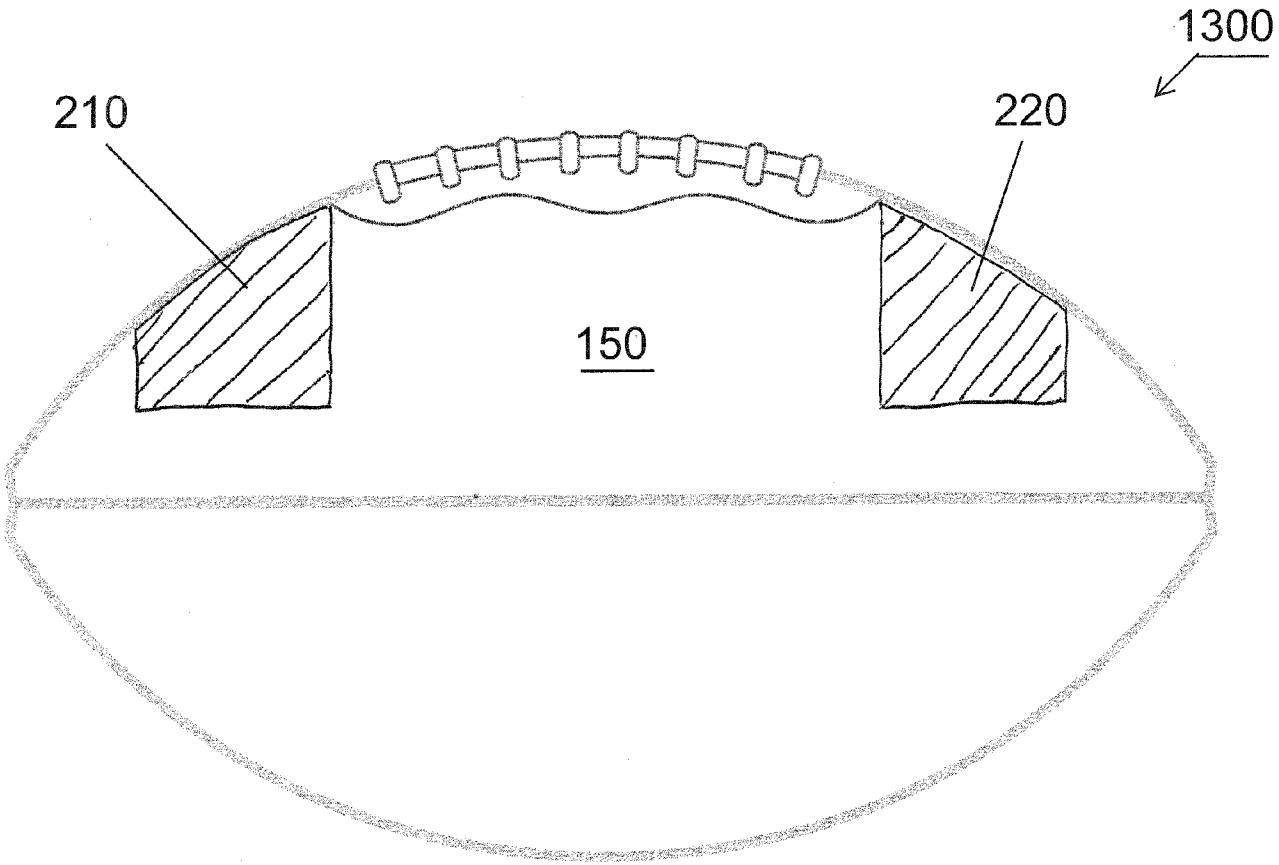
FIG. 13 is a side view showing a seventh exemplary embodiment of a football with grip zones. Here, the football has no stripes, and the grip zones are wider and extend across the area in which a stripe would have been placed.

FIG. 13 is a side view of a seventh exemplary embodiment 1300 of the game ball of the present disclosure. Here, the top panels 150 do not have any stripes. Two grip zones 210, 220 are present. Each grip zone extends across the area where a stripe would have been located, and has a length (along the longitudinal axis) that is greater than a 1-inch stripe.

Figure 14:
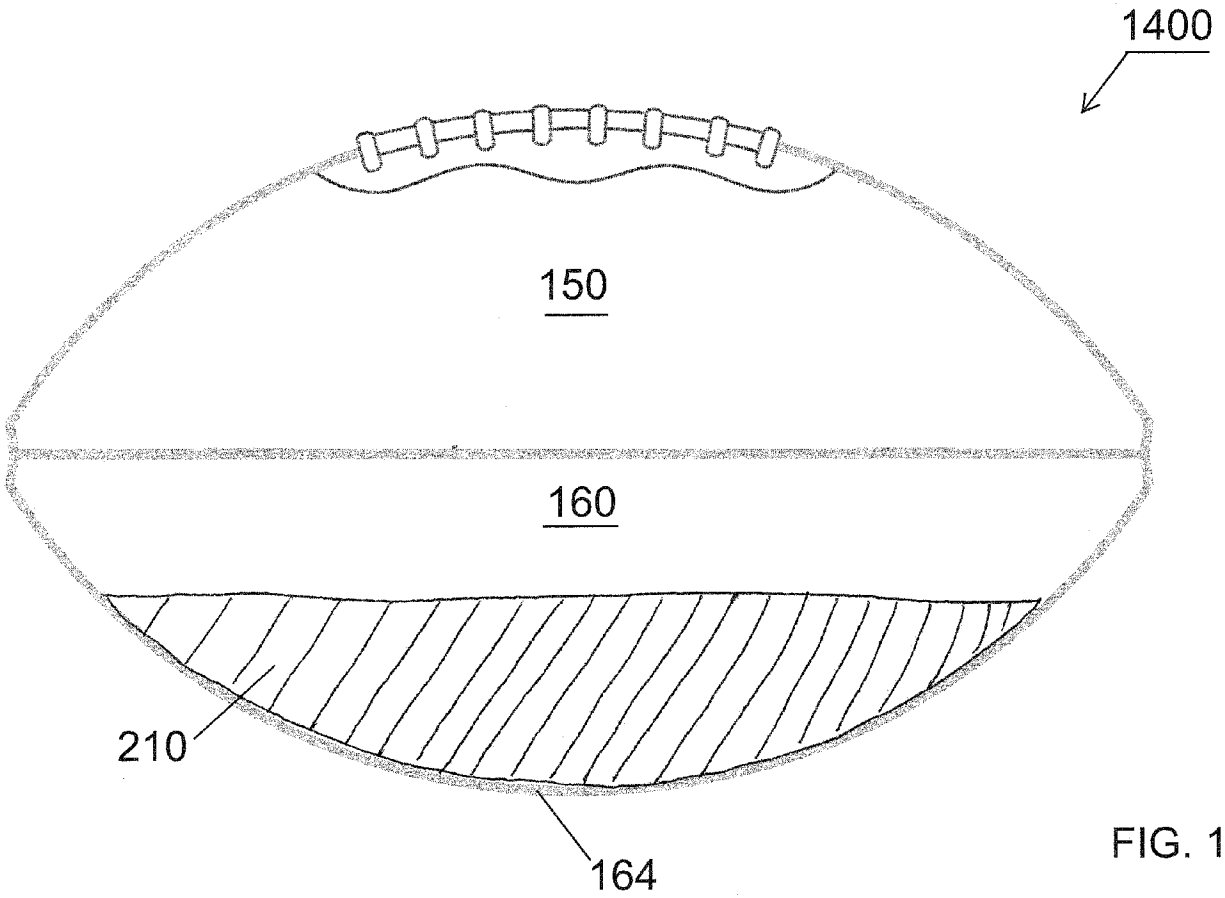
FIG. 14 is a side view showing an eighth exemplary embodiment of a football with grip zones. Here, the football has no stripes on the top panels, and the grip zones are located across a majority of the bottom panels. It is contemplated that this might be useful for punting.

FIG. 14 is a side view of an eighth exemplary embodiment 1400 of the game ball of the present disclosure. Here, the top panels 150 do not have any stripes. A grip zone 210 is present on each bottom panel 160. This grip zone is located along the vertical edge 164, and extends across the length of the ball. It is contemplated that this grip zone may be especially helpful for punting.

It is contemplated that any combination of the top panels and bottom panels discussed above, and any combination of the location of their grip zones may be used. For example, the top panel of FIG. 6 could be combined with the bottom panel of FIG. 10 or FIG. 11, and could include the ogive grip zone at the ends as shown in FIG. 12. Alternatively, the top panel of FIG. 8 could be combined with the bottom panel of FIG. 10 or FIG. 11, and could include the ogive grip zone at the ends as shown in FIG. 12. As yet another example, the top panel of FIG. 9 could be combined with the bottom panel of FIG. 10 or FIG. 11, and could include the ogive grip zone at the ends as shown in FIG. 12. As a fourth example, the top half of the game ball could use only the grip zones 250, 260 that parallel the lacing as seen in FIG. 8.

In some embodiments, the game ball includes at least eight grip zones, with at least four grip zones being located on the at least one top panel and at least four grip zones being located on the at least one bottom panel. Generally, it is contemplated that the grid zones will be located on the game ball so that the longitudinal sides of the game ball are mirror images of each other.

A thread is used to form the grip zones. The thread may be soft, compressible, and elastic. The thread can be a coated thread comprising internal fibers or braided fibers having an outer polymeric (e.g. latex) coating. The fiber(s) can be formed from a high tensile strength polymer, such as a polyamide, polyester, metal, combinations thereof, etc. The outer coating can be compressible, soft, and resilient and provide an enhanced feel. In certain embodiments, the thread is coated with a natural or synthetic rubber. Texture enhancing agents may also be included in the thread material. In other embodiments, the thread can consist of a single strand of highly compressible rubber or other extruded polymers.

The thread used for the grip zone(s) can have a breaking strength of 83 newtons or higher; and/or an elongation at break of 40% to about 700%. The thread may be, for example, a polyester filament yarn of composition 280dt/48f, a twist count (Z) (T/m) of 335, a twist count (S) (T/m) of 560, a breaking strength of 91.5 Newtons, elongation at break of 40.5%, and a melting point of 240° C.

The thread can have a wide range of widths and thicknesses, and can be uniform or non-uniform in configuration. For example, the thread may have a cross-sectional diameter of 0.25 mm to 1.27 mm, including from about 0.4 to about 0.6 mm; or alternatively has a value of 1900+/−40 dtex. The thread is preferably white, tan, brown, or black in color, however other colors or color combinations are also possible, such as those matching certain team colors. Additionally, the thread may have certain exterior surface configurations in order to improve the gripping ability. For example, in certain embodiments, the outer surface of the thread is not smooth, and can be fibrous or textured.

The grip zone is formed by sewing or weaving a pattern of stitches using the thread upon the cover panel/cover layer. Any stitching pattern or design is contemplated for the grip zone. For example, as seen in FIG. 6, the grip zone can be formed by stitches that intersect each other in a regular grid pattern. As another example, the design for the grip zone/stitches could be in the form of a straight line, a herringbone pattern, a diamond pattern, or a chevron (V-) pattern. If the design is directional, the stitches can vary independently in their direction. For example, the chevron pattern could be made pointing in one direction for one grip zone and in the opposite direction for another grip zone. This enhances the grip ability, feel, and possible aesthetics of the game ball.

It should be noted that any given grip zone is not required to be made from only one thread, and could be made from multiple threads. Similarly, one thread could be used to form multiple grip zones. The disclosure should also not be construed as requiring that a given thread can only be used on one cover panel, though this can be done. For example, an extra-long thread could be used to form a grip zone on multiple panels.

The resulting grip zone has a static coefficient of friction that is greater than the coefficient of friction of the cover panel and/or the stripe member (if present). The coefficient of friction of the grip zone can be affected by factors including the tackiness of the thread, the size of the thread, the stitching pattern used in the grip zone, and whether the thread is raised above the outer surface or flush against the outer surface. In particular embodiments, the thread used to form the grip zone has a static coefficient of friction that is greater than the coefficient of friction of the cover panel and/or the stripe member.

The static coefficient of friction for the thread, the grip zone, the cover panel, and the stripe member can be measured in accordance with ASTM D1894, entitled "Standard Test Method for Static and Kinetic Coefficients of Friction of Plastic Film and Sheeting." Generally, a sample of the desired surface to be tested is attached to the bottom of a metal sled, which is then run across a test surface for a given distance. The initial force to start the sled and the average force over the distance is recorded. The force measuring device should be able to measure frictional force to +/−5% of its value. The measured forces are divided by the sled weight to obtain the static and kinetic coefficient of friction. It should be recognized that the coefficient of friction for the thread should be measured using a film made from the same material as the exterior surface of the thread. For example, to measure the coefficient of friction of the grip zone, a sample of the grip zone can be cut out and attached to the bottom of the metal sled. For purposes of this application, the test surface upon which the metal sled is run to measure the static coefficient of friction is the "pebbled" side of a piece of Pattern 62 glass (not the smooth side of the glass).

As previously mentioned, stitching may be present on the cover panels proximate the lacing, for example to hold the patch material and/or common in place relative to the cover panel. It is contemplated that this stitching proximate the lacing can also be done using the thread with enhanced frictional characteristics, so that the resultant stitching has a greater static coefficient of friction than the outer surface of the cover panel. Again, the disclosure should also not be construed as requiring the stitching on a given cover panel to be formed from the same coated thread, though this can be done.

Figure 15:
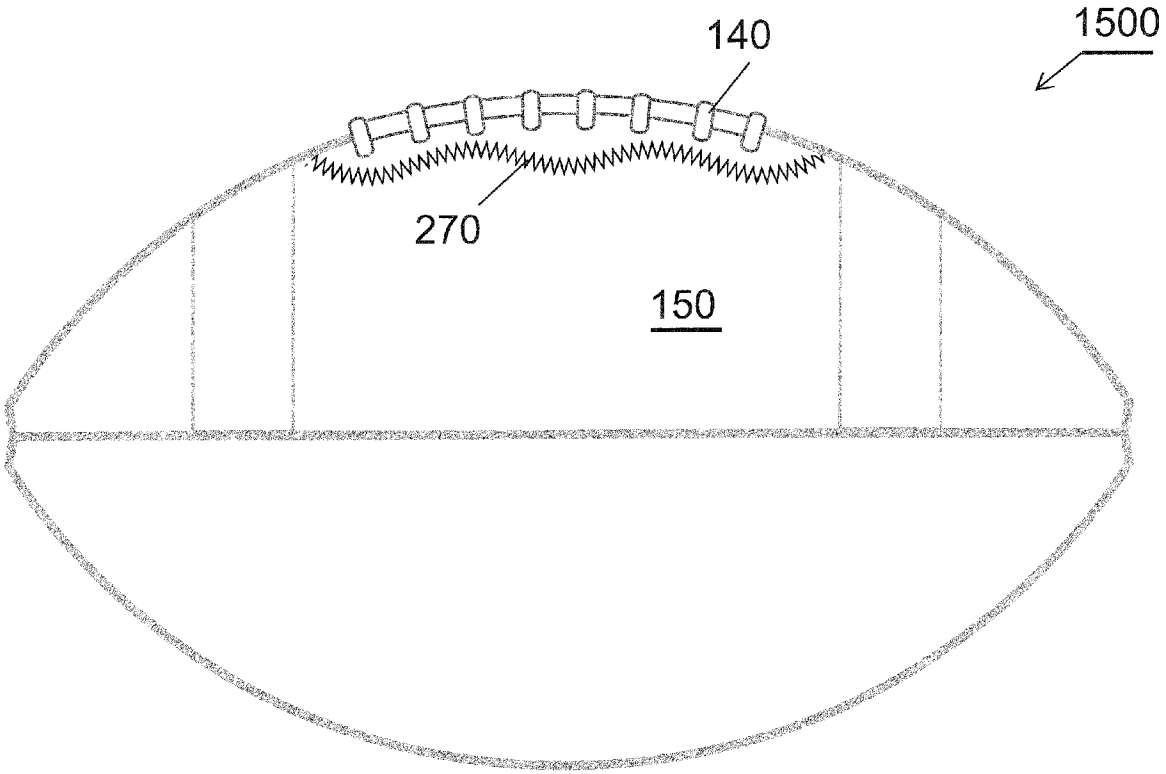
FIG. 15 is a side view of a football having a frictional stitching proximate the lacing that has enhanced grip characteristics. Here, the frictional stitching has a zigzag design.
Figure 16:
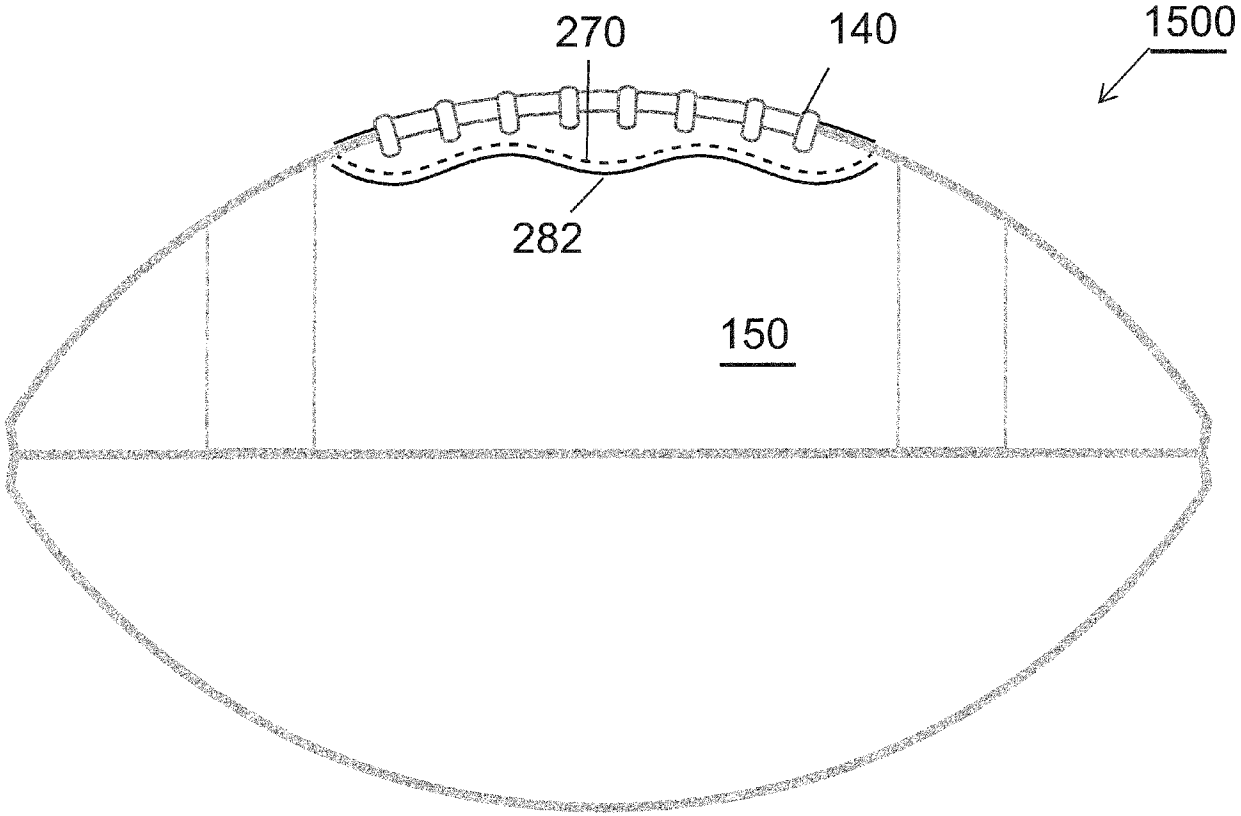
FIG. 16 is a side view of a football having a patch and a stitching proximate the lacing. Here, the frictional stitching has a straight design.
Figure 17:
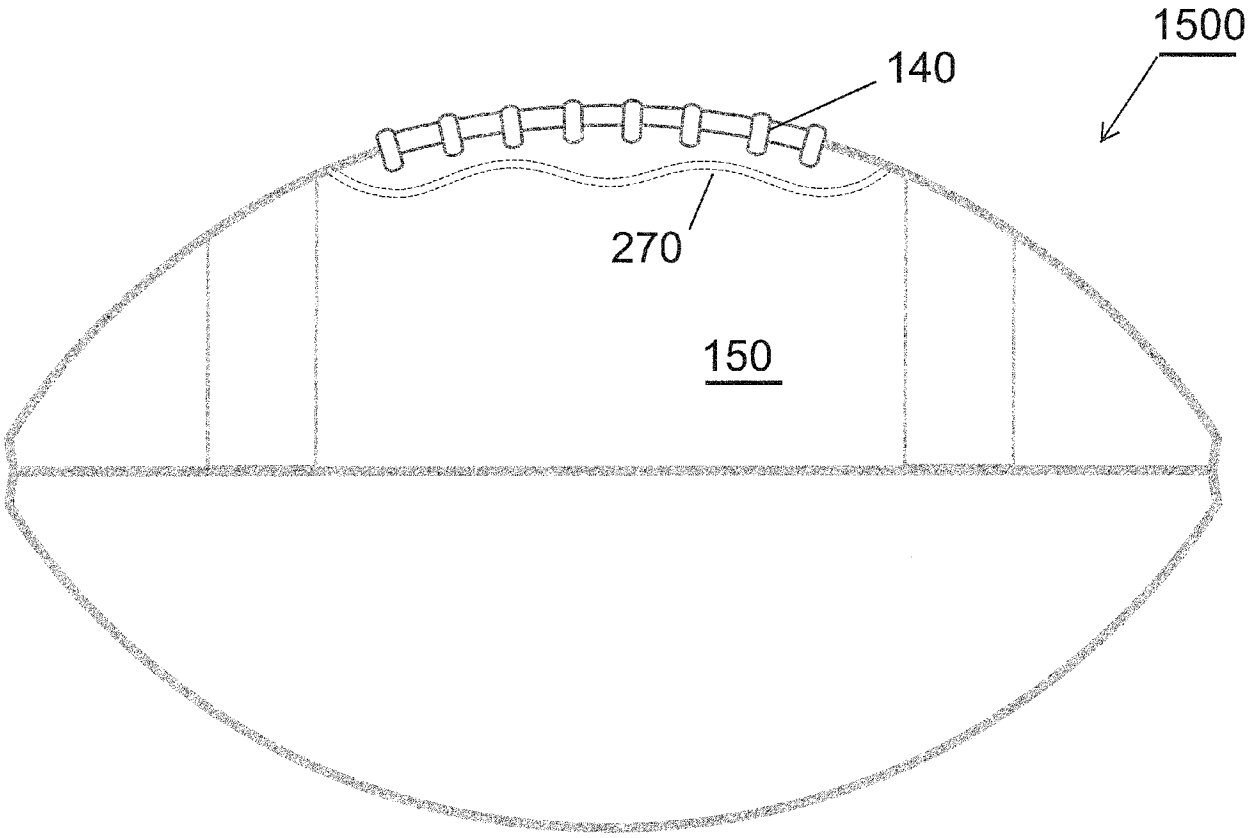
FIG. 17 is a side view of the football having two stitchings proximate the lacing, with both stitchings having a straight design.
Figure 18:
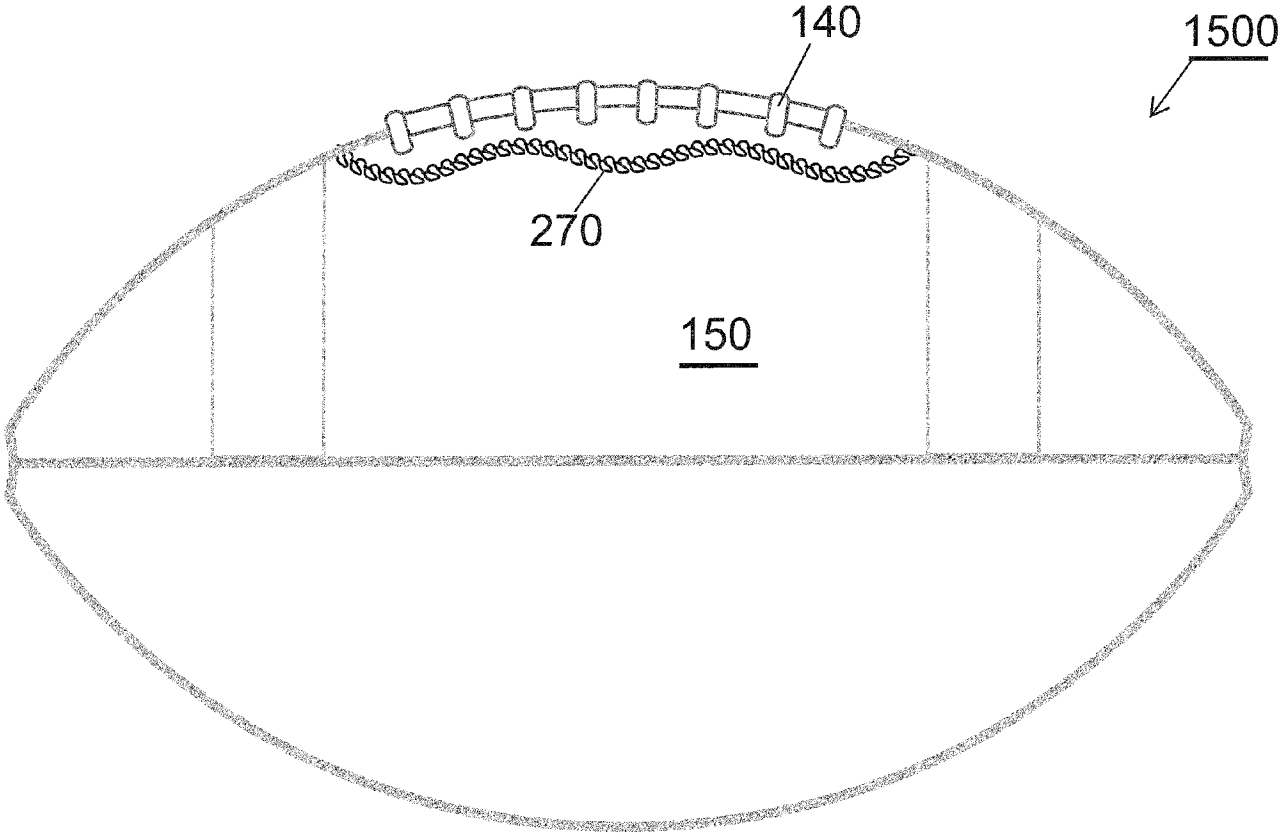
FIG. 18 is a side view of a football having a stitching proximate the lacing. Here, the frictional stitching has a zipper or serpentine design.
Figure 19:
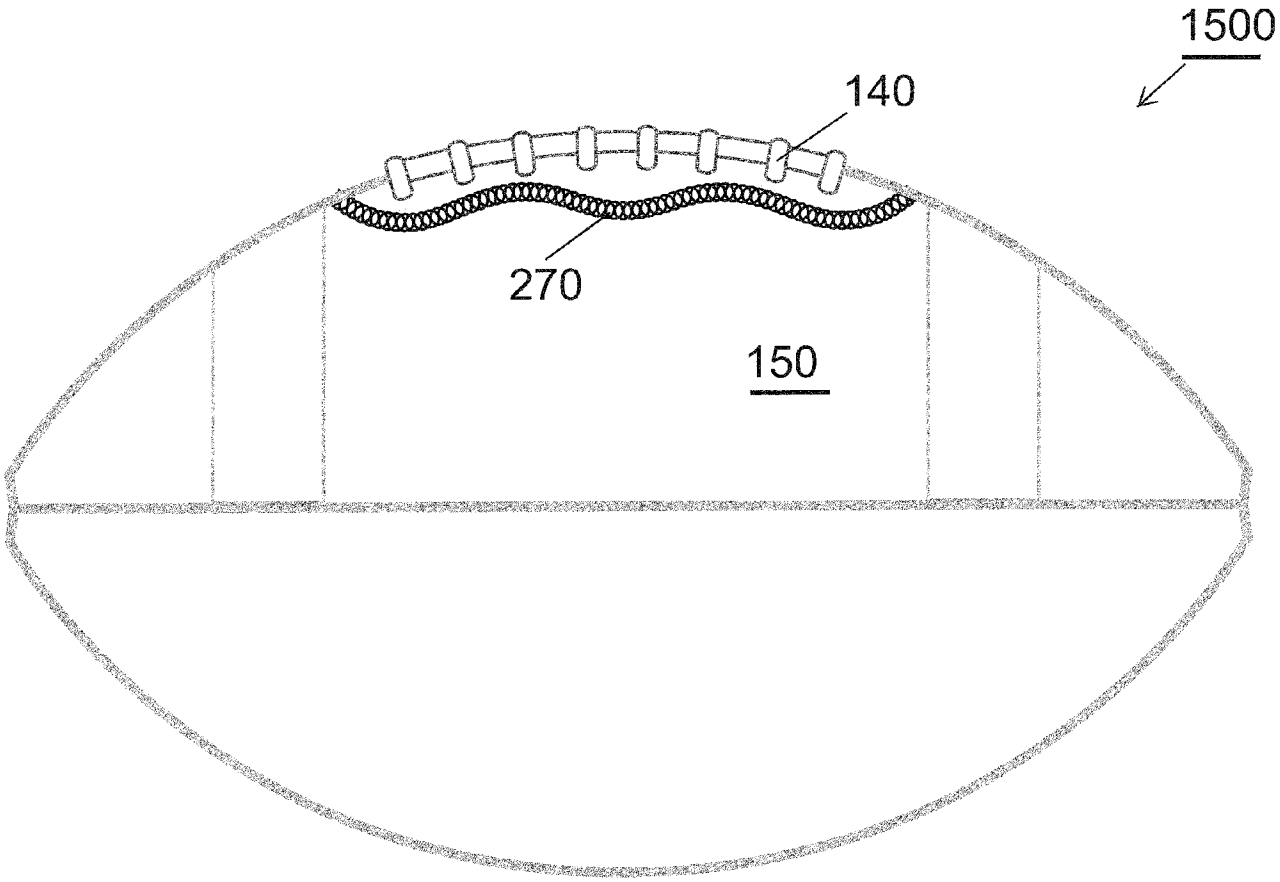
FIG. 19 is a side view of a football having a frictional stitching proximate the lacing. Here, the frictional stitching has a loop design.
Figure 20:
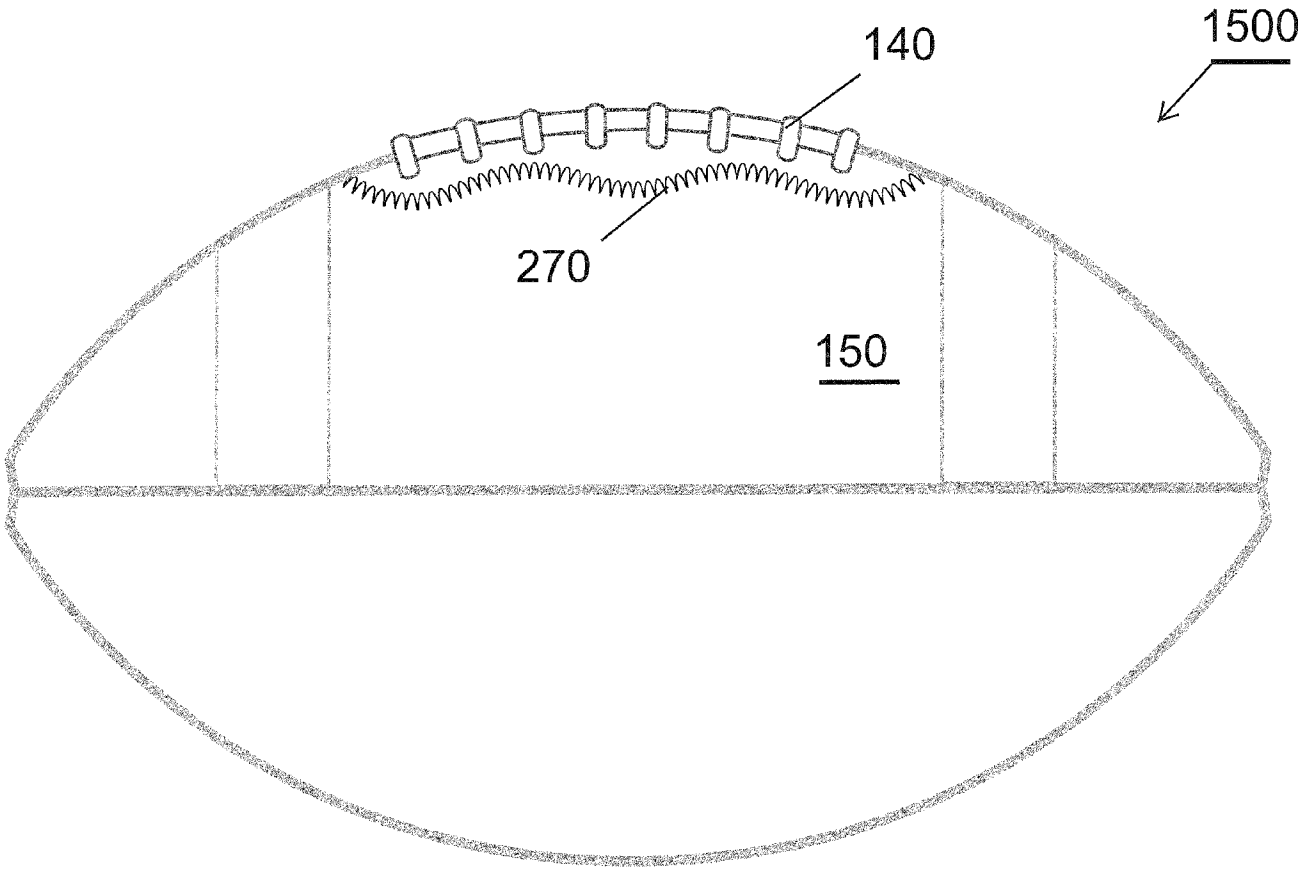
FIG. 20 is a side view of a football having a stitching proximate the lacing. Here, the frictional stitching has an arch design.

Several variations of the stitching pattern/design proximate the lacing are illustrated in FIGS. 15-20. The stitching 270 is present around the lacing 140 on the top panel 150 of the game ball 1500. In FIG. 15, the stitching has a zigzag design. In FIG. 16, the stitching has a straight design. In this embodiment, the shape of the tongue or patch is indicated with a solid line (reference numeral 282), and the stitching is on the perimeter of the patch. In FIG. 17, two stitchings are present, each having a straight design. In FIG. 18, the stitching has a zipper design. In FIG. 19, the stitching has a loop design. In FIG. 20, the stitching has an arch design.

The various components of the game ball can be made using materials and methods known in the art.

The inflatable bladder of the game ball holds air or a gas or a mixture thereof. The bladder, when properly inflated, provides the primary resilience to a finished football. The bladder can be made from latex or butyl rubber and fitted with a valve stem (not shown) for introducing air into the ball as inflated pressure to the structure. Butyl rubber bladders retain air for longer periods of time and offer an excellent combination of contact quality and air retention. Latex bladders tend to provide better surface tension, give proper bounce, feel softer, and provide same angle rebounce characteristics. Natural latex rubber bladders usually offer the softest feel and response, but do not provide the best air retention because they contain micro-pores. Micro-pores are tiny holes that slowly allow air to escape. Balls with natural rubber bladders need to be reinflated (at least once a week) more often than balls with butyl bladders (stay properly inflated for weeks at a time) due to these micro-pores. Some balls use carbon-latex bladders, where carbon powder is added to the latex to plug some of the microscopic holes that are in pure latex bladders. Carbon latex bladders retain air longer than bladders made from latex rubber. Some manufacturers also use bladders made from multiple layers of polyurethane. The bladder can be of appropriate thickness as to reasonably protect against loss of air due to puncture, temperature change, or other foreseeable occurrences.

The bladder may have a reinforcing winding layer (not shown). The winding layer is typically formed of monofilaments of polyester and/or nylon and is wrapped around the bladder (not shown) in either a pre-determined pattern or a random fashion to help the final ball retain its shape under typical inflation pressure and under the stresses of use. The windings can be coated with an adhesive which allows them to adhere to the bladder and also to each other.

The cloth liner, foam liner, and cover layer may be formed from materials known in the art. For example, the foam liner can be made from styrene butadiene rubber (SBR); polybutadiene rubbers; polyurethane foams; ethylene vinyl acetate (EVA) foams; polypropylene foams; ethylene propylene diene monomer (EPDM); and combinations and blends thereof.

The cover panels of the game ball can be made using leather, or a rubber, or some other polymeric material. Leather is a material created through the tanning of hides and skins of animals, frequently cattle hide. The tanning process converts the putrescible skin or hide into a durable, long-lasting and versatile natural material suitable for various uses. Generally, four different types of leather exist having different characteristics, i.e. full-grain, top-grain, corrected grain, and split grain. Full-grain leather is a common material used to form the cover of game balls such as footballs. In this regard, full-grain leather is formed from animal hide where only the hair has been removed, and the natural grain (texture) has been left on. Full-grain leather is thick. In contrast, with top-grain leather the natural grain has been removed. Full-grain leather is very desirable to use because of its durability and minimal chemical treatment. Full-grain leather also has a "pebbly" texture which enhances the gripability of the surface. It is specifically contemplated that the game balls described herein use full-grain leather panels to make the cover layer. Of course, synthetic leather panels or other polymeric cover layers are also contemplated.

The following examples are for purposes of further illustrating the present disclosure. The examples are merely illustrative and are not intended to limit the balls made in accordance with the disclosure to the materials, conditions, or process parameters set forth therein.

EXAMPLES

A Comparative Sample and a Test Sample were tested according to ASTM D1894. The Comparative Sample was a square of approximately 8 inches by 8 inches, and consisted solely of a bare painted skin, which corresponded to a painted stripe. The Test Sample measured approximately 8.5 inches by 9 inches, and consisted of parallel rows of thread stitched in a straight design, each row approximately one-sixteenth inch apart, also on top of a painted skin. Each Sample was taped to the bottom of a sled weighing 200 grams. The test surface was a piece of Pattern 62 glass measuring 16 inches by 6 inches by one-eight inch (thickness), with the pebbled side contacting the Sample.

The sled was then dragged across the pebbled side of the Pattern 62 glass at least five times to increase the precision of the measurements. The Test Sample was run in both the machine direction (parallel to the stitches) and in the cross direction (perpendicular to the stitches). The measured static and kinetic coefficients of friction are shown below in Table 1.

| Example | Average Static Coefficient | Average Kinetic Coefficient |
|---|---|---|
| Comparative Sample | 0.241 | 0.216 |
| Test Sample - Machine | 0.274 | 0.283 |
| Test Sample - Cross | 0.263 | 0.256 |

The Test Sample having stitchings had a higher static coefficient of friction than the Comparative Sample (only painted) in both the machine and cross directions. The Test Sample having stitchings also had a higher kinetic coefficient of friction than the Comparative Sample in both the machine and cross directions.

The game balls and methods of the present disclosure have been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A game ball, comprising:

an inflatable bladder; and a cover layer surrounding the bladder, the cover layer being formed from a plurality of cover panels;

wherein at least one of the cover panels includes at least one grip zone formed from stitches created by a thread interwoven into the cover panel, the grip zone having a static coefficient of friction greater than a static coefficient of friction of an outer surface of the cover panel, when measured according to ASTM D1894 using the pebbled side of a Pattern 62 glass as the test surface;

wherein the at least one grip zone includes a first grip zone and a second grip zone, the first grip zone and the second grip zone both being located on the same longitudinal side of the at least one cover panel, and the first grip zone and the second grip zone forming a first set of grip zones;

wherein (a) the first grip zone has an annular shape, and the second grip zone has a different annular shape; or (b) the first grip zone has a trapezoidal shape, and the second grip zone has a different trapezoidal shape.

2. The game ball of claim 1, wherein the at least one cover panel includes a first stripe member attached to the outer surface on a first longitudinal side of the cover panel, the first stripe member having a first stripe edge adjacent the outer surface and a second stripe edge adjacent the outer surface.

3. The game ball of claim 2, wherein the at least one grip zone includes a first grip zone and a second grip zone, the first grip zone being located on the outer surface next to the first stripe edge, and the second grip zone being located on the outer surface next to the second stripe edge.

4. The game ball of claim 2, wherein the at least one grip zone is located upon the first stripe member between the first stripe edge and the second stripe edge.

5. A game ball, comprising:

an inflatable bladder;

a cover layer surrounding the bladder, the cover layer being formed from a plurality of cover panels; and a lacing;

wherein the plurality of cover panels includes at least one top panel that contacts the lacing and includes at least one bottom panel that does not contact the lacing; and wherein the cover layer includes a first grip zone, a second grip zone, a third grip zone, and a fourth grip zone on the cover layer, the first grip zone and the third grip zone being of identical shape and the second grip zone and the fourth grip zone being of identical shape to each other but a different shape from the first grip zone and the third grip zone, each grip zone having a static coefficient of friction greater than a static coefficient of friction of the cover layer, when measured according to ASTM D1894 using the pebbled side of a Pattern 62 glass as the test surface.

6. The game ball of claim 5, wherein the first grip zone is located on a first longitudinal side of the at least one top panel proximate a center of the top panel, the second grip zone is located on the first longitudinal side of the at least one top panel distal the center of the top panel, the third grip zone is located on a second longitudinal side of the at least one top panel proximate the center of the top panel, and the fourth grip zone is located on the second longitudinal side of the at least one top panel distal the center of the top panel.

7. The game ball of claim 5, wherein the at least one top panel includes a first stripe member attached to the outer surface on a first longitudinal side of the top panel and a second stripe member attached to the outer surface on a second longitudinal side of the top panel, each stripe member having an interior stripe edge proximate the lacing and an exterior stripe edge distal to the lacing.

8. The game ball of claim 7, wherein the first grip zone is next to the interior stripe edge of the first stripe member, the second grip zone is next to the exterior stripe edge of the first stripe member, the third grip zone is next to the interior stripe edge of the second stripe member, and the fourth grip zone is next to the exterior stripe edge of the second stripe member.

9. The game ball of claim 7, wherein the at least one top panel has a horizontal edge which contacts the at least one bottom panel and a vertical edge which contacts the lacing; and wherein the first grip zone is located upon the first stripe member proximate to the vertical edge, the second grip zone is located upon the first stripe member proximal to the horizontal edge, the third grip zone is located upon the second stripe member proximal to the vertical edge, and the fourth grip zone is located upon the second stripe member proximal to the horizontal edge.

10. The game ball of claim 5, wherein the at least one bottom panel has a horizontal edge which contacts the at least one top panel and a vertical edge which contacts another bottom panel; and wherein the first grip zone is located on a first longitudinal side of the at least one bottom panel proximate a center of the at least one bottom panel, the second grip zone is located on the first longitudinal side of the at least one bottom panel distal the center of the at least one bottom panel, the third grip zone is located on a second longitudinal side of the at least one bottom panel proximate the center of the at least one bottom panel, and the fourth grip zone is located on the second longitudinal side of the at least one bottom panel distal the center of the at least one bottom panel.

11. The game ball of claim 10, wherein the first grip zone, the second grip zone, the third grip zone, and the fourth grip zone are either (a) proximate the horizontal edge; or (b) distal to the horizontal edge.

* * * * *